US012357902B1

(12) United States Patent
Honickman

(10) Patent No.: US 12,357,902 B1
(45) Date of Patent: Jul. 15, 2025

(54) SNOW SCOOTERS

(71) Applicant: SHINC INC., Toronto (CA)

(72) Inventor: Hart Noah Honickman, Toronto (CA)

(73) Assignee: SHINC INC., Toronto (CA)

( * ) Notice: Subject to any disclaimer, the term of this patent is extended or adjusted under 35 U.S.C. 154(b) by 0 days.

(21) Appl. No.: 19/070,886

(22) Filed: Mar. 5, 2025

Related U.S. Application Data

(60) Provisional application No. 63/678,362, filed on Aug. 1, 2024.

(51) Int. Cl.
*A63C 5/06* (2006.01)
*A63C 5/00* (2006.01)
*A63C 5/03* (2006.01)

(52) U.S. Cl.
CPC ..... *A63C 5/06* (2013.01); *A63C 5/003* (2013.01); *A63C 5/03* (2013.01)

(58) Field of Classification Search
CPC ..... A63C 5/06; A63C 5/003; A63C 5/03
See application file for complete search history.

(56) References Cited

U.S. PATENT DOCUMENTS

| | | | | |
|---|---|---|---|---|
| 1,968,975 | A | 8/1934 | Upsacker et al. | |
| 2,006,325 | A | 6/1935 | Scholtes | |
| 3,332,697 | A | 7/1967 | Hagen | |
| 4,138,128 | A | 2/1979 | Criss | |
| 4,533,150 | A | 8/1985 | Hardy | |
| 4,606,548 | A | 8/1986 | Little | |
| 6,139,031 | A | 10/2000 | Wingard | |
| 6,474,660 | B1 | 11/2002 | Warren | |
| 6,923,455 | B2 | 8/2005 | Sullivan | |
| 6,929,267 | B2 | 8/2005 | Sullivan et al. | |
| 6,935,640 | B2 | 8/2005 | Gille et al. | |
| 6,957,818 | B2 | 10/2005 | McClure et al. | |
| 6,969,076 | B2 | 11/2005 | Spiers | |
| 7,374,180 | B2 * | 5/2008 | Farmer | B62B 17/08 280/28.11 |
| 7,547,023 | B2 | 6/2009 | Yau | |
| 8,177,241 | B1 | 5/2012 | Marks et al. | |
| 8,905,410 | B1 | 12/2014 | Winchester et al. | |
| 11,046,348 | B2 * | 6/2021 | Ballu | B62B 13/16 |
| 2003/0209901 | A1 | 11/2003 | Hamel | |

(Continued)

FOREIGN PATENT DOCUMENTS

| | | |
|---|---|---|
| CN | 206434831 U | 8/2017 |
| CN | 105498189 B | 3/2019 |

(Continued)

*Primary Examiner* — Brian L Swenson

(57) ABSTRACT

A snow scooter includes (a) a gliding board extending along a board axis and having at least one anchoring zone; and (b) an edging control assembly mounted to the board for controlling an edging angle of the board. The edging control assembly includes (i) a control bar projecting upwardly from the board and (ii) a torque-transmission assembly including an anchoring structure fastened to the at least one anchoring zone, and a torsion bar extending generally parallel to the board axis between a free end rotationally fixed to a lower end of the control bar and an anchored end rotationally fixed to a coupling section of the anchoring structure for applying a tilting torque to the at least one anchoring zone about the board axis in response to a lateral force applied to the control bar by a rider.

30 Claims, 15 Drawing Sheets

(56) References Cited

U.S. PATENT DOCUMENTS

| | | | | |
|---|---|---|---|---|
| 2005/0225042 | A1 | 10/2005 | Liu | |
| 2006/0131824 | A1 | 6/2006 | Hong | |
| 2010/0276912 | A1 | 11/2010 | Lange et al. | |
| 2012/0061928 | A1 | 3/2012 | Ryan | |
| 2013/0292922 | A1 | 11/2013 | Gyr | |
| 2014/0367933 | A1 | 12/2014 | Winchester et al. | |
| 2015/0157923 | A1 | 6/2015 | Nejad | |
| 2017/0137082 | A1 | 5/2017 | Bellon | |
| 2018/0221744 | A1 | 8/2018 | Ball | |
| 2019/0046861 | A1* | 2/2019 | Arcouette | B62B 17/065 |
| 2021/0093942 | A1* | 4/2021 | Poutiainen | A63C 17/017 |
| 2021/0370157 | A1 | 12/2021 | Ballu | |
| 2022/0371645 | A1* | 11/2022 | Gostoli | B62B 17/065 |

FOREIGN PATENT DOCUMENTS

| | | | |
|---|---|---|---|
| DE | 4101550 | A1 | 7/1992 |
| DE | 20010818 | U1 | 2/2001 |
| EP | 778053 | A2 | 6/1997 |
| EP | 1759738 | A1 | 3/2007 |
| FR | 2732609 | A1 | 10/1996 |
| FR | 2732610 | A1 | 1/1998 |
| GB | 2209951 | A | 6/1989 |
| WO | 2005069821 | A2 | 8/2005 |
| WO | 2018127154 | A1 | 7/2018 |
| WO | 2019175067 | A1 | 9/2019 |

* cited by examiner

SNOW SCOOTERS

CROSS-REFERENCE TO RELATED APPLICATION(S)

This application claims the benefit of U.S. Provisional Patent Application No. 63/678,362 filed Aug. 1, 2024, which is hereby incorporated herein by reference in its entirety.

FIELD

The teachings disclosed herein relate generally to sports equipment, and more specifically, to snow scooters.

INTRODUCTION

United States Pat. App. Pub. No. 2005/0225042 (Liu) discloses a snow board including a board member, a bracket to support a handle and having a number of holes for receiving fasteners which may secure the bracket to the board member, to adjustably secure the bracket and the handle to the board member at different locations, according to such as different heights of different users, for allowing the snow board to be suitably used or operated by various users. The board member includes a number of orifices formed in two rows for aligning with the holes of the bracket, and for receiving the fasteners, and a number of lock members engaged in the orifices for threading with the fasteners.

United States Pat. App. Pub. No. 2013/0292922 (Gyr) discloses a lever action snowboard including a snowboard body, and lever substructure coupled to a central region of the body. The lever substructure is constructed with a lever that can be actuated by a rider of the snowboard while riding the snowboard, and it may include a handle that can be grasped by the user. The snowboard also includes dual foot pads, each coupled to opposing ends of the snowboard body and constructed to locate the feet of the rider while riding the snowboard.

SUMMARY

The following summary is intended to introduce the reader to various aspects of the applicant's teaching, but not to define any invention.

According to some aspects, a snow scooter includes (a) a gliding board having a bottom surface for gliding on a low-friction substrate and a top surface spaced apart from the bottom surface by a board thickness. The top and bottom surfaces extend longitudinally along a board axis between front and rear edges of the board, and extend laterally between side edges of the board. The top surface has a front-foot support region, a rear-foot support region axially rearward of the front-foot support region, and a central region axially intermediate the front-foot and rear-foot support regions. The snow scooter further includes (b) an edging control assembly mounted to the board for controlling an edging angle between the low-friction substrate and the bottom surface of the board. The edging control assembly includes: (i) a control bar projecting upwardly from a lower end of the control bar adjacent the top surface of the board to an upper end of the control bar, the upper end comprising a handle portion, and the lower end positioned axially forward of the front-foot support region, and (ii) a torque-transmission assembly coupling the control bar to the board. The torque-transmission assembly includes a torsion bar extending along a torsion bar axis generally parallel to the board axis between a free end and an anchored end of the torsion bar. The free end is rotationally fixed to the lower end of the control bar to inhibit relative rotation between the free end and the lower end about the torsion bar axis, and the anchored end is rotationally fixed to the central region to inhibit relative rotation between the anchored end and the central region about the torsion bar axis for applying a tilting torque to the central region about the board axis in response to a lateral force applied to the handle portion by a rider.

In some examples, the anchored end comprises a pair of attachment points spaced laterally apart from each other toward respective side edges of the board and positioned on laterally opposite sides of the torsion bar axis, each attachment point vertically fixed to the central region for vertically and rotationally fixing the anchored end thereto.

In some examples, each of the attachment points is slidably coupled to the central region to accommodate limited axial translation of the attachment points along the board axis.

In some examples, the anchored end comprises a lever extending transversely to the torsion bar axis between a pair of opposed lever ends, each lever end comprising a respective attachment point.

In some examples, the torque-transmission assembly comprises a mounting bracket fastened to the central region. The mounting bracket includes a pair of mounting apertures spaced laterally apart from each other on laterally opposite sides of the torsion bar axis and directed laterally inwardly toward the torsion bar axis, and each lever end is received and held vertically captive in a respective mounting aperture.

In some examples, each mounting aperture comprises a slot extending along the board axis, and each lever end is slidably received in a respective slot for accommodating limited axial translation of the lever end along the slot.

In some examples, the torque-transmission assembly includes a support projecting upwardly relative to the top surface and atop which the torsion bar is supported to hold the free end of the torsion bar above the top surface of the board.

In some examples, the support is configured to accommodate flexural and torsional deformation of the board. In some examples, the support comprises a spherical bearing for accommodating flexural and torsional deformation of the board.

In some examples, the snow scooter further includes a front foot pad extending over the front-foot support region and a rear foot pad extending over the rear-foot support region. In some examples, each of the front and rear foot pads comprises a plurality of traction plates spaced axially apart from each other and independently mounted to the top surface to accommodate bending and twisting of the board along the front-foot and rear-foot support regions.

In some examples, the board has a length between the front edge and the rear edge, and the central region is located within a central third of the length.

According to some aspects, a snow scooter includes: (a) a gliding board having a bottom surface for gliding on a low-friction substrate and a top surface spaced apart from the bottom surface by a board thickness. The top and bottom surfaces extend longitudinally along a board axis between front and rear edges of the board, and extend laterally between side edges of the board. The top surface has a front-foot support region, a rear-foot support region axially rearward of the front-foot support region, a central region axially intermediate the front-foot and rear-foot support regions, and at least one anchoring zone. The snow scooter further includes (b) an edging control assembly mounted to the board for controlling an edging angle between the low-friction substrate and the bottom surface of the board. The edging control assembly includes: (i) a control bar projecting upwardly from a lower end of the control bar adjacent the top surface of the board to an upper end of the control bar, the upper end comprising a handle portion, and the lower end positioned axially forward of the front-foot support region, and (ii) a torque-transmission assembly coupling the control bar to the at least one anchoring zone. The torque-transmission assembly includes an anchoring structure fastened to the at least one anchoring zone, and a torsion bar extending along a torsion bar axis generally parallel to the board axis between a free end and an anchored end of the torsion bar. The free end is rotationally fixed to the lower end of the control bar to inhibit relative rotation between the free end and the lower end about the torsion bar axis, and the anchored end is positioned over the central region and rotationally fixed to a coupling section of the anchoring structure to inhibit relative rotation between the anchored end and the coupling section about the torsion bar axis for applying a tilting torque to the at least one anchoring zone about the board axis in response to a lateral force applied to the handle portion by a rider.

In some examples, the anchored end comprises a pair of attachment points spaced laterally apart from each other toward respective side edges of the board and positioned on laterally opposite sides of the torsion bar axis, each attachment point vertically fixed to the coupling section of the anchoring structure for vertically and rotationally fixing the anchored end thereto.

In some examples, each of the attachment points is slidably coupled to the coupling section of the anchoring structure to accommodate limited axial translation of the attachment points along the board axis.

In some examples, the anchored end comprises a lever extending transversely to the torsion bar axis between a pair of opposed lever ends, each lever end comprising a respective attachment point.

In some examples, the coupling section of the anchoring structure includes a pair of mounting apertures spaced laterally apart from each other on laterally opposite sides of the torsion bar axis and directed laterally inwardly toward the torsion bar axis. Each lever end is received and held vertically captive in a respective mounting aperture.

In some examples, each mounting aperture comprises a slot extending along the board axis, and each lever end is slidably received in a respective slot for accommodating limited axial translation of the lever end along the slot.

In some examples, the board has a length between the front edge and the rear edge, and the central region is located within a central third of the length.

In some examples, the torque-transmission assembly includes a support projecting upwardly relative to the top surface and atop which the torsion bar is supported to hold the free end of the torsion bar above the top surface of the board.

In some examples, the support is configured to accommodate flexural and torsional deformation of the board. In some examples, the support comprises a spherical bearing for accommodating flexural and torsional deformation of the board.

In some examples, the snow scooter further includes a front foot pad extending over the front-foot support region and a rear foot pad extending over the rear-foot support region.

In some examples, each of the front and rear foot pads comprises a plurality of traction plates spaced axially apart from each other and independently mounted to the top surface to accommodate bending and twisting of the board along the front-foot and rear-foot support regions.

In some examples, the at least one anchoring zone is located within the central region of the board for applying the tilting torque to the central region.

In some examples, the anchoring structure comprises a mounting bracket fastened to the central region, and the anchored end of the torsion bar is rotationally fixed to the mounting bracket to inhibit relative rotation about the torsion bar axis.

In some examples, the at least one anchoring zone comprises a front anchoring zone forward of the central region and a rear anchoring zone rearward of the central region for applying the tilting torque to the front and rear anchoring zones axially outboard of the central region.

In some examples, the anchoring structure comprises a pair of beam members spaced laterally apart from each other toward respective side edges of the board and positioned on laterally opposite sides of the torsion bar axis, each beam member extending along the board axis between a front portion of the beam member vertically fixed to the front anchoring zone and a rear portion of the beam member vertically fixed to the rear anchoring zone.

In some examples, the anchored end of the torsion bar has a pair of attachment points spaced laterally apart from each other toward respective side edges of the board and positioned on laterally opposite sides of the torsion bar axis, and each attachment point is vertically fixed relative to a respective beam member over the central region for rotationally fixing the anchored end to the coupling section of the anchoring structure to inhibit relative rotation between the anchored end and the coupling section about the torsion bar axis.

According to some aspects, a snow scooter includes: (a) a gliding board having a bottom surface for gliding on a low-friction substrate and a top surface spaced apart from the bottom surface by a board thickness. The top and bottom surfaces extend longitudinally along a board axis between front and rear edges of the board and extend laterally between side edges of the board. The top surface has a front-foot support region, a rear-foot support region axially rearward of the front-foot support region, a central region axially intermediate the front-foot and rear-foot support regions, and at least one anchoring zone. The snow scooter further includes (b) an edging control assembly mounted to the board. The edging control assembly includes: (i) a control bar projecting upwardly from a lower end of the control bar adjacent the top surface of the board to an upper end of the control bar, the upper end comprising a handle portion, and the lower end positioned axially forward of the front-foot support region, and (ii) a torque-transmission assembly coupling the control bar to the at least one anchoring zone. The torque-transmission assembly includes an anchoring structure fastened to the at least one anchoring zone, and a torsion bar extending along a torsion bar axis generally parallel to the board axis between a free end and an anchored end of the torsion bar. The free end is rotationally fixed to the lower end of the control bar to inhibit relative rotation between the free end and the lower end about the torsion bar axis, and the anchored end is positioned over the central region and rotationally fixed to a coupling section of the anchoring structure to inhibit relative rotation between the anchored end and the coupling section about the torsion bar axis such that a control angle between the low-friction substrate and a transverse axis fixed relative to the anchored end corresponds to at least one edging angle between the low-friction substrate and the bottom surface of the board.

In some examples, the control angle corresponds to at least one of: the edging angle exhibited at one or more points along the board, and an average of edging angles exhibited at a plurality of respective points along the board.

In some examples, the at least one anchoring zone is located within the central region of the board and the control angle corresponds to the edging angle exhibited at one or more points within the central region of the board.

In some examples, the at least one anchoring zone comprises a front anchoring zone forward of the central region and a rear anchoring zone rearward of the central region, and the control angle corresponds to an average of the edging angle exhibited at a point within the front anchoring zone and the edging angle exhibited at a point within the rear anchoring zone.

In some examples, the anchoring structure comprises a pair of beam members spaced laterally apart from each other toward respective side edges of the board and positioned on laterally opposite sides of the torsion bar axis, each beam member extending along the board axis between a front portion of the beam member vertically fixed to the front anchoring zone and a rear portion of the beam member vertically fixed to the rear anchoring zone.

In some examples, the anchored end of the torsion bar has a pair of attachment points spaced laterally apart from each other toward respective side edges of the board and positioned on laterally opposite sides of the torsion bar axis, and each attachment point is vertically fixed relative to a respective beam member over the central region for rotationally fixing the anchored end to the coupling section of the anchoring structure to inhibit relative rotation between the anchored end and the coupling section about the torsion bar axis.

DRAWINGS

For a better understanding of the described examples and to show more clearly how they may be carried into effect, reference will now be made, by way of example, to the accompanying drawings in which.

DESCRIPTION OF VARIOUS EXAMPLES

Figure 1:
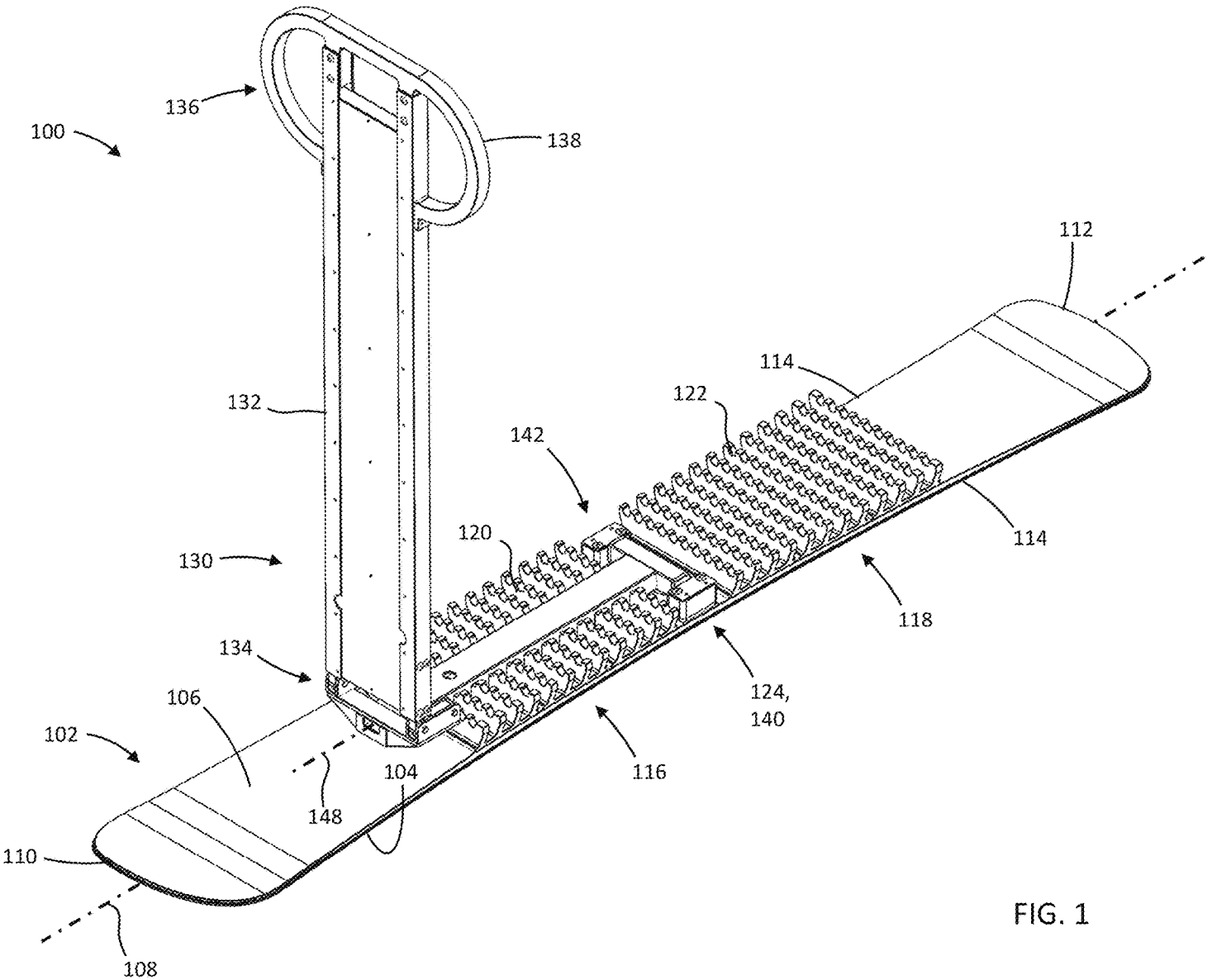
FIG. 1 is a front axonometric projection view of an example snow scooter.

Various apparatuses, systems, or processes will be described below to provide an example of each claimed invention. No example described below limits any claimed invention and any claimed invention may cover processes, systems, or apparatuses that differ from those described below. The claimed inventions are not limited to apparatuses, systems, or processes having all of the features of any one apparatus, system, or process described below or to features common to multiple or all of the apparatuses, systems, or processes described below. It is possible that an apparatus, system, or process described below is not an example of any claimed invention. Any invention disclosed in an apparatus, system, or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Snow scooters typically include at least one gliding board with a handle mounted on a vertical stem, allowing the rider to steer and control the device while standing on the board without bindings. While providing a unique recreational experience, some snow scooter designs can lack the ability to allow riders to effectively control and manipulate the edging angle of the gliding board, which can be important for maneuverability and performance in varying conditions.

In snowboarding, the ability to control the edging angle can be essential for executing carved turns, maintaining balance, and navigating different types of surfaces. The engaged side edge of the board can be defined as the side edge of the board that is most directly in contact with the snow. Lateral sideslip can be defined as a type of motion wherein some point on the engaged side edge of the board translates in a direction that is not tangent to the side edge at that point. A carved turn can be characterized as a turn that is executed in a manner that minimizes lateral sideslip, thereby minimizing the quantity of snow that is displaced from its resting position on the ground and, consequently, minimizing the drag (snow resistance) that is imposed upon the board during the turn. Conversely, a skidded turn can be characterized as a turn that includes significant lateral sideslip of the board. In the case of a board that features a waisted planform geometry, wherein the width of the board exhibits a local minimum near the center of the board, any non-zero edging angle can contribute to flexural deformation of the board that can cause the board to trace a curved arc in the surface of the snow, which contributes to the nature of the carved turn. In the case of a board that features a waisted planform geometry, a larger (steeper) edging angle will tend to result in carved turns of smaller turning radii, whereas a smaller (shallower) edging angle will tend to result in carved turns of larger turning radii. The edging angle can also be used to control the degree to which the board is permitted to undergo lateral sideslip. A larger edging angle can allow a side edge of the board to dig into the snow more deeply, thereby providing better grip and reducing lateral sideslip, especially when navigating hard-packed or icy surfaces. A smaller edging angle is useful when the athlete wishes to permit the board to undergo lateral sideslip. Precise control over the edging angle enables riders to execute various types of maneuvers and adapt their technique to changing terrain and snow conditions, enhancing their overall performance and safety. In some cases, techniques such as "pedaling" can be utilized to twist the board between the rider's feet (e.g. by performing a heel lift with one foot through plantarflexion and a toe lift with the other through dorsiflexion) to manipulate and vary the edging angle along the length of the board, which can provide for further control and performance improvements. The use of pedaling can be particularly useful during slow-speed maneuvering and when executing skidded turns, wherein the degree of lateral sideslip sometimes varies along the length of the board.

In some snow scooter designs, the handle can be fixed to the gliding board ahead of the rider's feet. Such configurations and lack of bindings can limit the ability to adjust the edging angle dynamically, vary it along the length of the board, and/or perform pedaling techniques, which may result in less precise control and reduced stability in some cases, particularly during slow-speed maneuvering and when executing skidded turns. As a result, riders may struggle to maintain balance and execute controlled maneuvers, which in some cases can diminish overall enjoyment and functionality of some snow scooter designs.

According to some aspects of the present disclosure, snow scooters are disclosed with edging control assemblies that can help overcome limitations of some other snow scooter designs. The edging control assemblies of the present disclosure can provide for more controlled operation of the snow scooter—for example, by permitting the rider to impose a counter-torque with either foot (without necessarily requiring bindings) to twist the board for more controlled manipulation of the edging angle. This can help improve control, stability, and/or performance relative to other snow scooter designs, and may offer a more enjoyable and versatile experience for snow scooter enthusiasts.

According to some aspects, snow scooters of the present disclosure include a gliding board extending along a board axis for gliding along a low-friction substrate (e.g. snow, ice, artificial/synthetic surfaces, etc.), and an edging control assembly mounted to the board for controlling an edging angle between the low-friction substrate and a bottom surface of the board. The edging control assembly includes a control bar projecting upwardly relative to the board. The control bar can be positioned ahead of the rider's feet in use. The edging control assembly further includes a torque-transmission assembly coupling the control bar to the board. In some examples, the torque-transmission assembly includes an anchoring structure fastened to at least one anchoring zone of the board and a torsion bar extending generally parallel to the board axis and coupling the control bar to the anchoring structure. The anchoring structure can include one or more anchoring components for transferring loads from the anchored end of the torsion bar to the at least one anchoring zone. In examples in which the anchoring structure includes a plurality of anchoring components, the anchoring components can be arranged in an interrelated manner to facilitate a direct or indirect connection of the anchored end of the torsion bar to the at least one anchoring zone. The anchoring components can be directly interconnected in some examples. In other examples, the anchoring components may not necessarily be directly connected to each other.

In some examples, the torsion bar extends between a free (first) end rotationally fixed to a lower end of the control bar and an anchored (second) end rotationally fixed to a coupling section of the anchoring structure for applying a tilting torque to the at least one anchoring zone about the board axis in response to a lateral force applied to the control bar by a rider. The term "torque" as used herein is intended to have the same meaning as "moment of force", and shall not necessarily be limited to a moment of force that causes twisting deformation.

In some examples, the anchored end and coupling section of the anchoring structure are positioned over a central region of the board generally between the rider's feet in use. The at least one anchoring zone can comprise a central anchoring zone located within the central region in some examples, and in other examples, the at least one anchoring zone can comprise a pair of anchoring zones including a front anchoring zone ahead of the central region and a rear anchoring zone behind the central region. Such configurations of the anchored end and anchoring zone(s) can allow for tilting of the board to be counteracted through loads imposed by either foot of the rider (e.g. through a "pedaling" technique to impose counter-torque) to urge twisting of the board about the board axis as desired to adjust local edging angles along the board axis for improved control. This also provides for a control angle between the low-friction substrate and a transverse axis fixed relative to the anchored end to correspond to at least one edging angle between the low-friction substrate and a bottom surface of the board. In some examples, the control angle can correspond to the edging angle exhibited at one or more points along the board (e.g. a point within the anchoring zone when located within the central region), or an average of edging angles exhibited at a plurality of respective points along the board (e.g. a weighted average of edging angles at respective points in the front and rear anchoring zones).

Referring to FIG. 1, an example snow scooter 100 is shown. The snow scooter 100 includes a gliding board 102 having a bottom surface 104 for gliding on a low-friction substrate. The gliding board 102 has a top surface 106 spaced apart from the bottom surface 104 by a board thickness. The bottom and top surfaces 104, 106 extend longitudinally along a board axis 108 between front and rear edges 110, 112 of the board 102. The bottom and top surfaces 104, 106 extend laterally between side edges 114 of the board 102. In the example illustrated, the board axis 108 is laterally centered between the side edges 114 of the board 102.

The top surface 106 has a front-foot support region 116 overtop of which a front foot of a rider is supported, and a rear-foot support region 118 axially rearward of the front-foot support region 116 and overtop of which a rear foot of the rider is supported. In the example illustrated, a front foot pad 120 extends over the front-foot support region 116 for supporting the front foot of the rider, and a rear foot pad 122 extends over the rear-foot support region 118 for supporting the rear foot of the rider.

Figure 4:
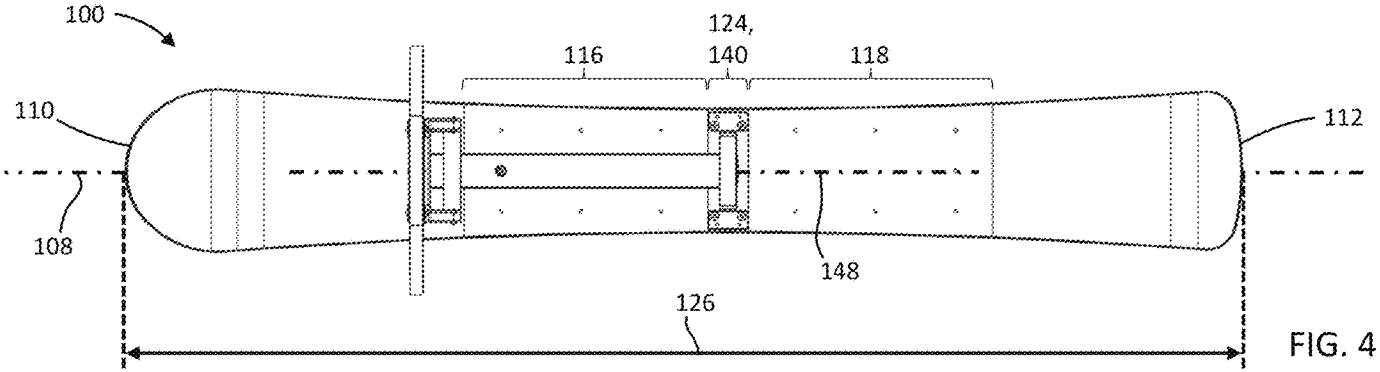
FIG. 4 is a top view of the snow scooter of FIG. 2.
Figure 5:
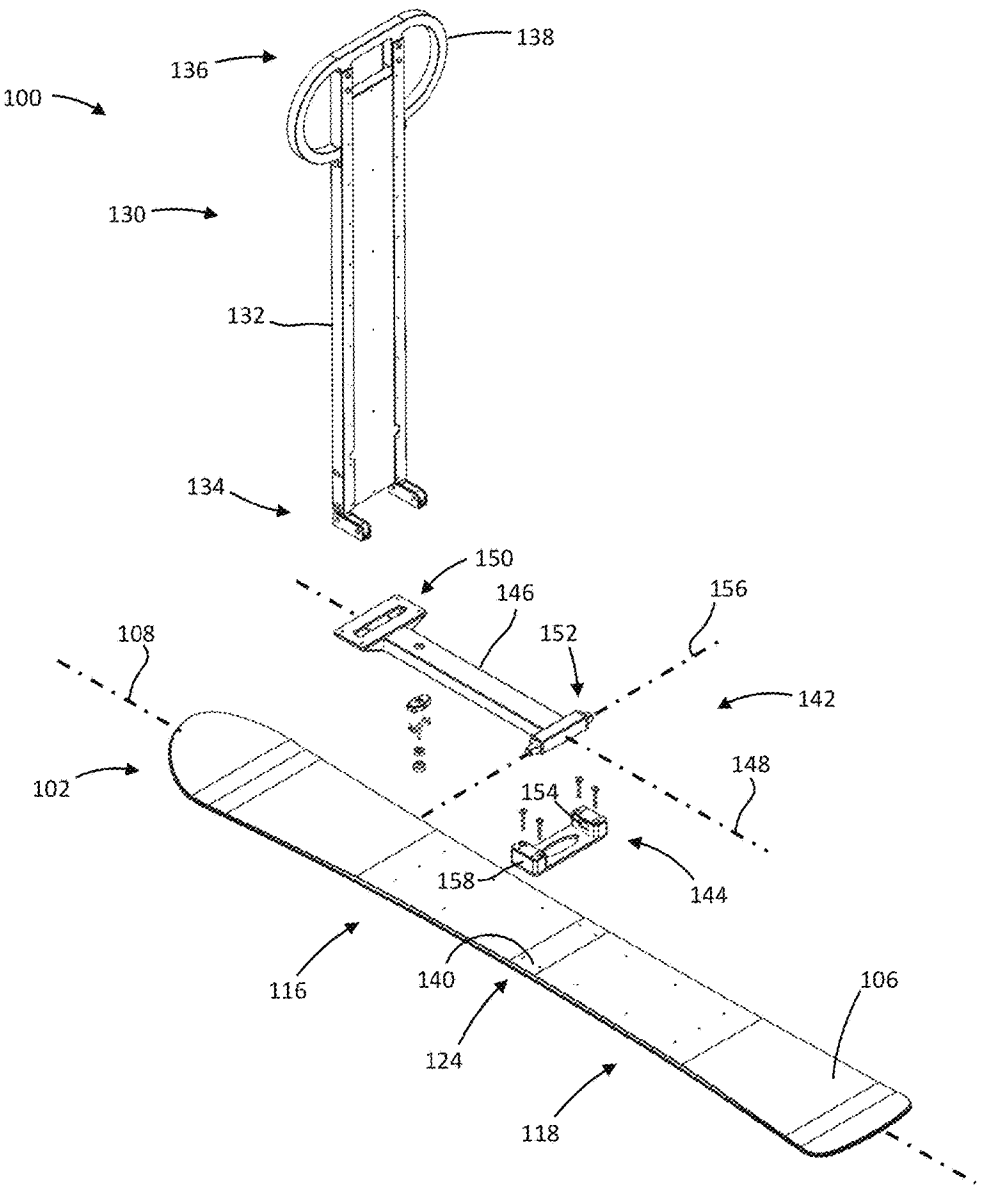
FIG. 5 is an exploded axonometric projection view of the snow scooter of FIG. 2.

In the example illustrated, the top surface 106 of the board 102 has a central region 124 axially intermediate the front-foot and rear-foot support regions 116, 118 (and the front and rear foot pads 120, 122, in the example illustrated). Referring to FIG. 4, in the example illustrated, the board 102 has a length 126 from the front edge 110 to the rear edge 112. The central region 124 is located within a central third of the length 126, and in the example illustrated, the central region 124 is located within a central fifth of the length 126. In the example illustrated, at least a portion of each of the front-foot support region 116 (and front foot pad 120) and the rear-foot support region 118 (and rear foot pad 122) extends within the central third of the length 126. In the example illustrated, an entirety of each of the front-foot support region 116 (and front foot pad 120) and the rear-foot support region 118 (and rear foot pad 122) is within a central three-fifths of the length 126.

Referring to FIG. 1, in the example illustrated, the snow scooter 100 includes an edging control assembly 130 mounted to the board 102 for controlling an edging angle between the bottom surface 104 of the board 102 and the low-friction substrate. In the example illustrated, the edging control assembly 130 includes a control bar 132 projecting upwardly from a lower end 134 of the control bar 132 adjacent the top surface 106 of the board 102 to an upper end 136 of the control bar 132. The upper end 136 of the control bar 132 comprises a handle portion 138 for engagement by the rider. In the example illustrated, the lower end 134 of the control bar 132 is positioned axially forward of the front-foot support region 116.

Figure 2:
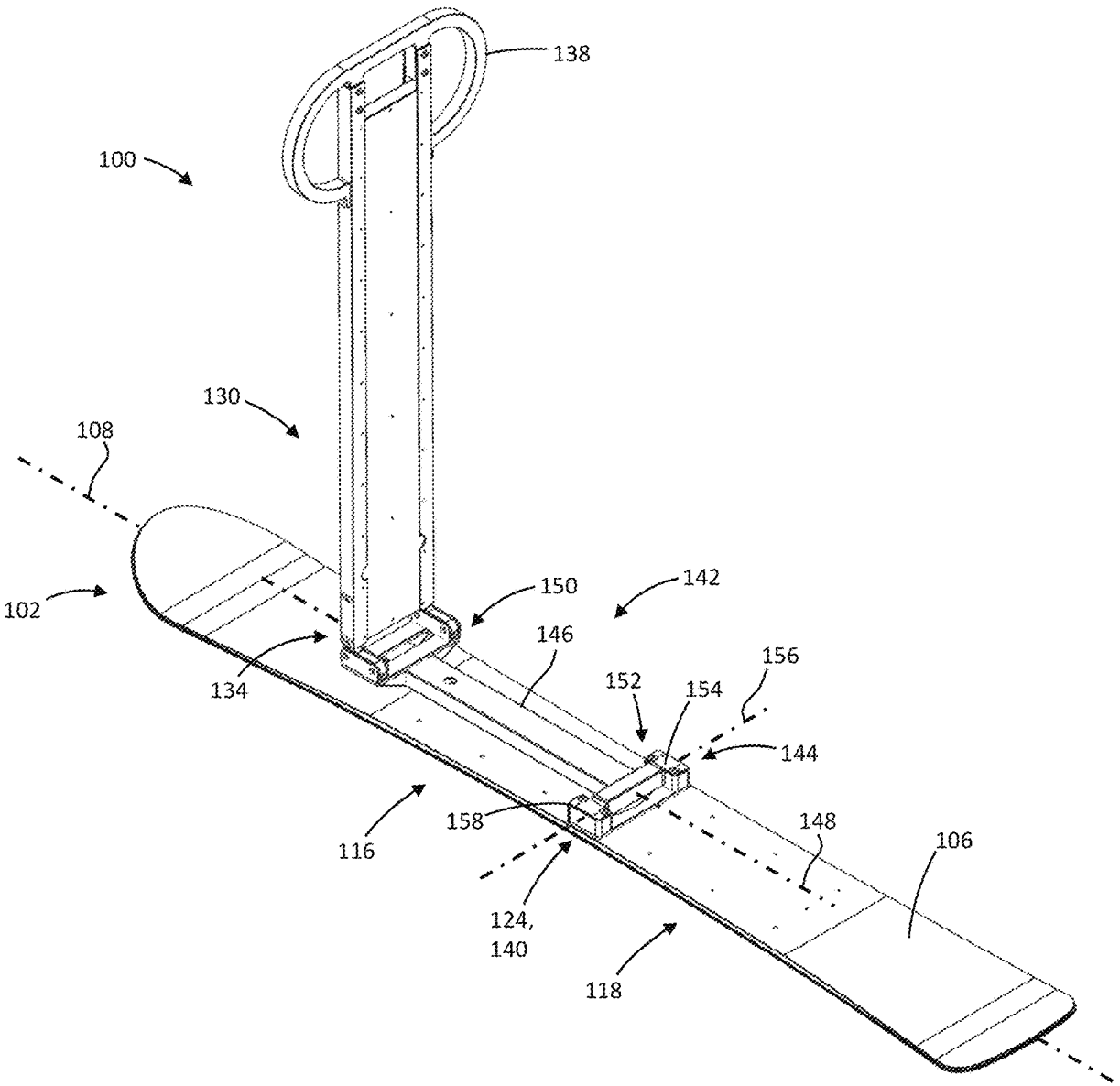
FIG. 2 is a rear axonometric projection view of the snow scooter of FIG. 1, but with foot pads removed.

In the example illustrated, the top surface 106 of the board 102 has at least one anchoring zone 140, and the edging control assembly 130 includes a torque-transmission assembly 142 coupling the control bar 132 to the at least one anchoring zone 140. The anchoring zone 140 is located within the central region 124 of the board 102 in the example illustrated. Referring to FIG. 2, in the example illustrated, the torque-transmission assembly 142 includes an anchoring structure 144 fastened to the at least one anchoring zone 140. The torque-transmission assembly 142 further includes a torsion bar 146 extending along a torsion bar axis 148 generally parallel to the board axis 108 between a free end 150 of the torsion bar 146 and an anchored end 152 of the torsion bar 146 axially opposite the free end 150. In the example illustrated, the free end 150 of the torsion bar 146 is axially forward of the front-foot support region 116 and rotationally fixed to the lower end 134 of the control bar 132 to inhibit relative rotation between the free end 150 and the lower end 134 about the torsion bar axis 148. The anchored end 152 of the torsion bar 146 is positioned over the central region 124 of the board 102. The anchored end 152 is rotationally fixed to a coupling section 154 of the anchoring structure 144 to inhibit relative rotation between the anchored end 152 and the coupling section 154 about the torsion bar axis 148 for applying a tilting torque to the at least one anchoring zone 140 about the board axis 108 in response to a lateral force applied to the handle portion 138 of the control bar 132 by a rider. Such a configuration allows for a control angle between the low-friction substrate and a transverse axis 156 fixed relative to the anchored end 152 to correspond to at least one edging angle between the low-friction substrate and the bottom surface 104 of the board 102. In the example illustrated, the control angle corresponds to an edging angle exhibited within the central region 124 of the board 102.

In the example illustrated, the anchoring structure 144 comprises a mounting bracket 158 fastened to the central region 124. The anchored end 152 of the torsion bar 146 is rotationally fixed to the mounting bracket 158 to inhibit relative rotation therebetween about the torsion bar axis 148 for applying the tilting torque to the central region 124. This can permit tilting of the central region 124 in either direction about the board axis 108 via the edging control assembly 130, including during vertical deflection (bending) of the board 102. This can also allow for the tilting to be counteracted through loads imposed to either of the front-foot support region 116 and the rear-foot support region 118 by the rider's feet (e.g. through a "pedaling" technique to impose counter-torque) to urge twisting of the board 102 about the board axis 108 as desired to adjust local edging angles along the board axis 108 for improved control.

Figure 6:
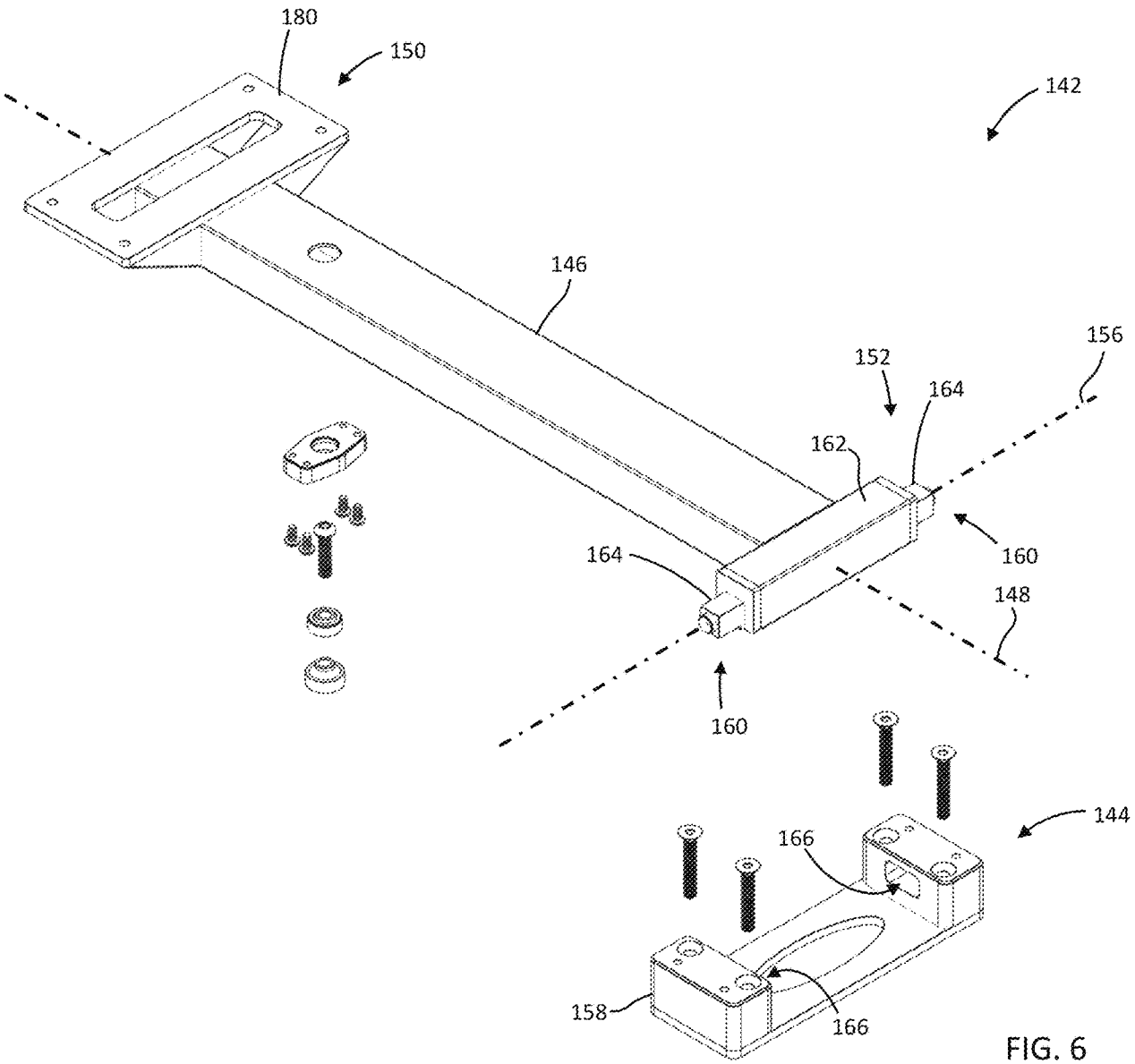
FIG. 6 is an exploded top axonometric projection view of a torque-transmission assembly of the snow scooter of FIG. 2.
Figure 8:
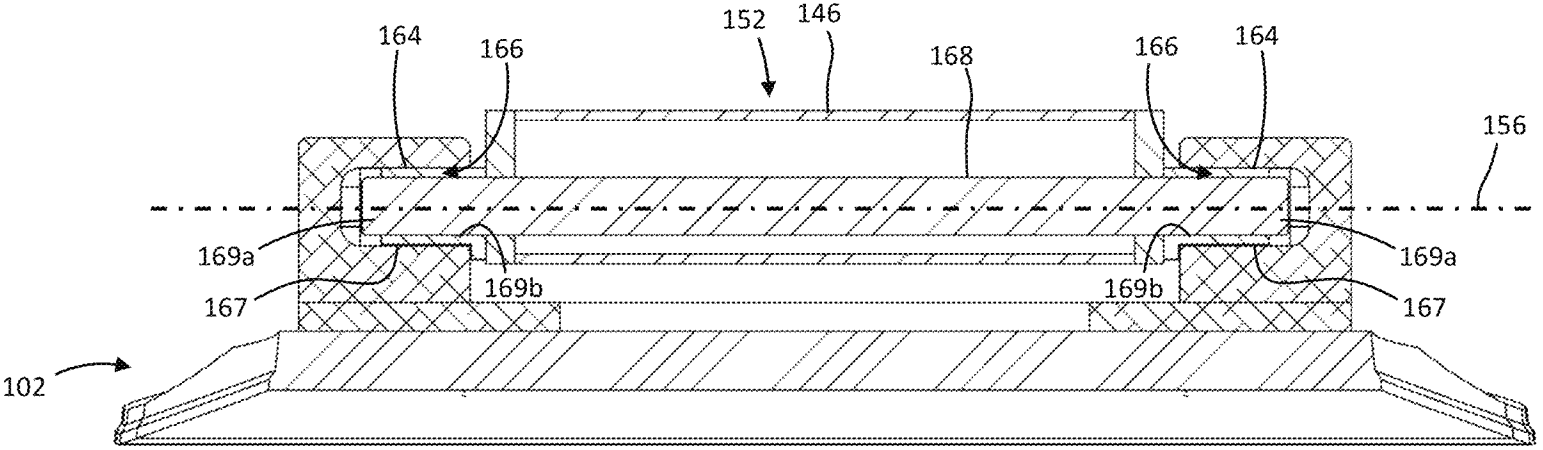
FIG. 8 is a cross-sectional view of the snow scooter of FIG. 2, taken along line 8-8 in FIG. 3.

Referring to FIG. 6, in the example illustrated, the anchored end 152 of the torsion bar 146 comprises a pair of attachment points 160 spaced laterally apart from each other toward respective side edges 114 of the board 102 and positioned on laterally opposite sides of the torsion bar axis 148. In the example illustrated, each attachment point 160 is vertically fixed to the central region 124 for vertically and rotationally fixing the anchored end 152 thereto. This can allow for, for example, applying a downward force on one side of the board axis 108 and simultaneously an upward force on the other side of the board axis 108 in response to a lateral force applied to the handle portion 138 (e.g. in the form of a force couple about the board axis 108), which can improve edging angle control. This can also provide for improved manipulation of the edging angle and more controlled twisting of the board 102 through the loads exerted by the rider's feet. In the example illustrated, the anchored end 152 comprises a lever 162 extending transversely to the torsion bar axis 148 along the transverse axis 156 between a pair of laterally opposed lever ends 164 defining respective attachment points 160. In the example illustrated, the mounting bracket 158 includes a pair of mounting apertures 166 spaced laterally apart from each other on laterally opposite sides of, and directed laterally inwardly toward, the torsion bar axis 148. Referring to FIG. 8, each lever end 164 is received and held vertically captive in a respective mounting aperture 166. In the example illustrated, each mounting aperture 166 comprises a slot extending along the board axis 108, and each lever end 164 is slidably received in a respective slot for accommodating limited axial translation of the lever end 164 along the slot. In the example illustrated, each lever end 164 comprises a slider block 167 received in a respective mounting aperture 166. In the example illustrated, the lever 162 comprises an axle 168 extending along the transverse axis 156 and defining a pair of pivot pins 169*a* spaced laterally apart from each other on laterally opposite ends of the lever 162. Each pin 169*a* is received in a pivot pin aperture 169*b* of a respective slider block 167 for accommodating limited pivoting of the torsion bar 146 relative to the board 102 about the transverse axis 156.

In some examples, the attachment points 160 can be axially offset relative to each other along the torsion bar axis 148 (e.g. with the attachment point on one side of the torsion bar axis 148 being positioned axially rearward of the attachment point on the opposite side of the torsion bar axis 148). In such examples, the anchored end can have a lever extending along an oblique angle relative to the torsion bar axis 148 between axially offset lever ends defining the attachment points on opposite sides of the torsion bar axis 148. In such examples, the anchored end may have a lever that is not parallel to the transverse axis. In some examples, this can help accommodate a forward stance of the rider, with their feet angled toward the front of the board, while allowing for application of the "pedaling" technique by the rider's feet to apply counter-torque for edging angle manipulation (e.g. by moving the lever generally clear of the toe of the athlete's rear foot and heel of the athlete's front foot).

Figure 7:
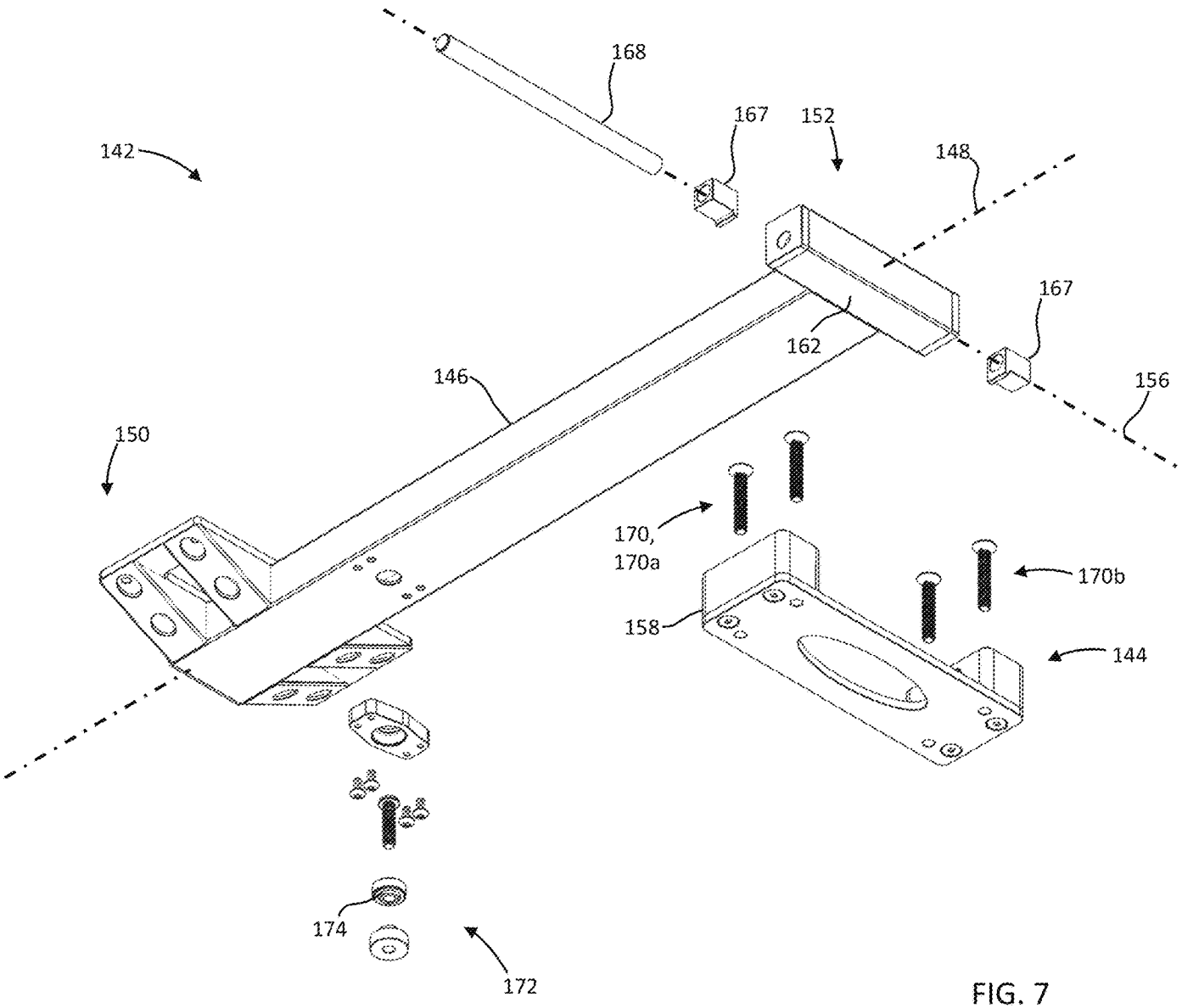
FIG. 7 is an exploded bottom axonometric projection view of the torque-transmission assembly of FIG. 6.

Referring to FIG. 7, in the example illustrated, the mounting bracket 158 is fastened to the central region 124 through a plurality of fasteners 170. The plurality of fasteners 170 includes a first set of one or more fasteners 170*a* on one side of the board axis 108 (and torsion bar axis 148) and a second set of one or more fasteners 170*b* on the opposite side of the board axis 108 (and torsion bar axis 148).

Figure 3:
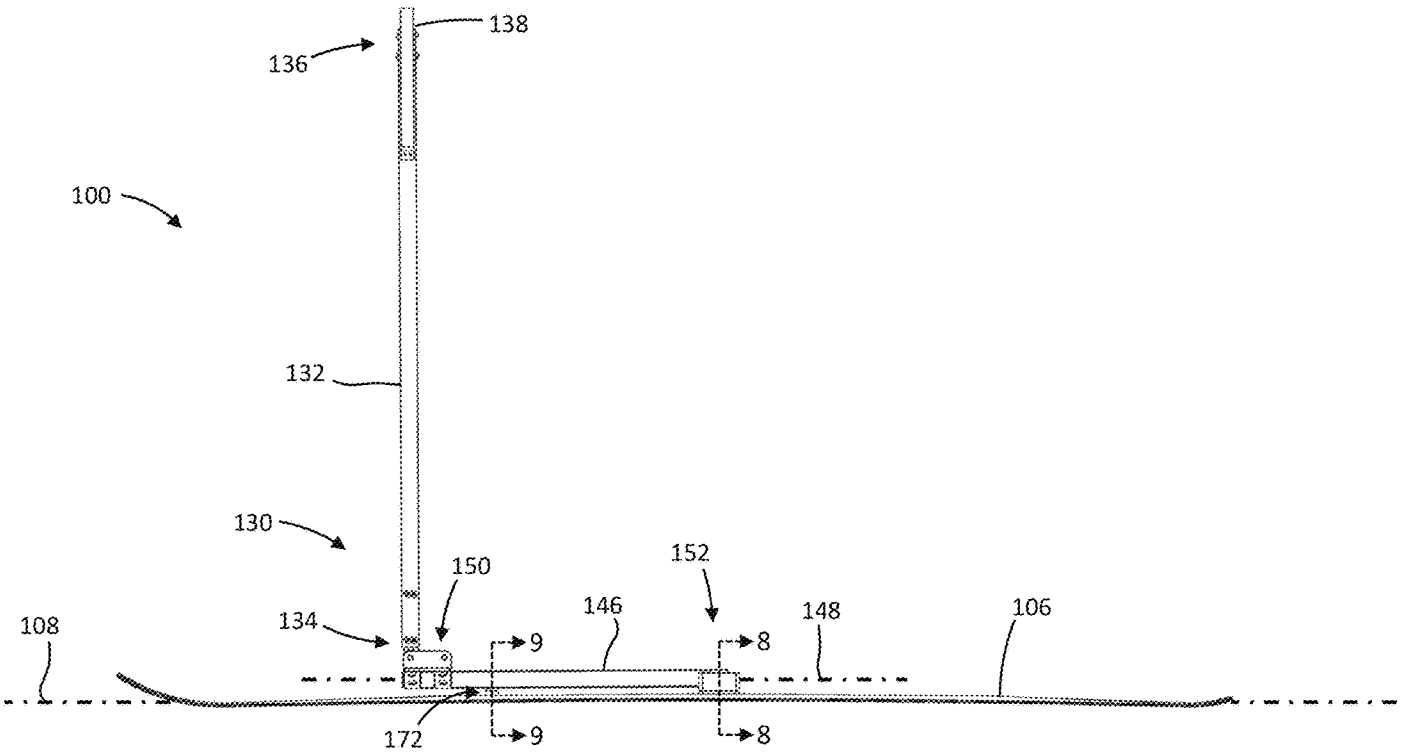
FIG. 3 is a side elevation view of the snow scooter of FIG. 2.
Figure 9:
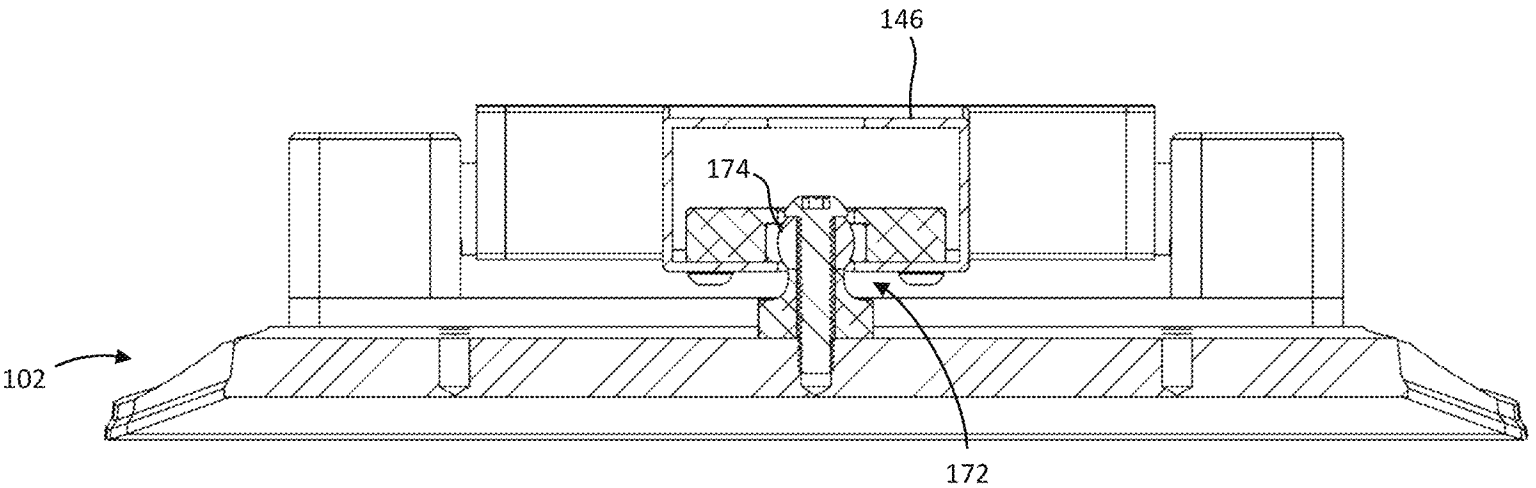
FIG. 9 is another cross-sectional view of the snow scooter of FIG. 2, taken along line 9-9 in FIG. 3.

Referring to FIG. 3, in the example illustrated, the torque-transmission assembly 142 includes a support 172 projecting upwardly relative to the top surface 106 and atop which the torsion bar 146 is supported to hold the free end 150 of the torsion bar 146 above the top surface 106 of the board 102. Referring to FIG. 9, in the example illustrated, the support 172 comprises a spherical bearing 174 for accommodating flexural and torsional deformation of the board 102. In the example illustrated, the spherical bearing 174 is coupled to a bottom of the torsion bar 146 toward the free end 150 and limits horizontal and vertical translation of the torsion bar 146 while accommodating the flexural and torsional deformation of the board 102.

Figure 10:
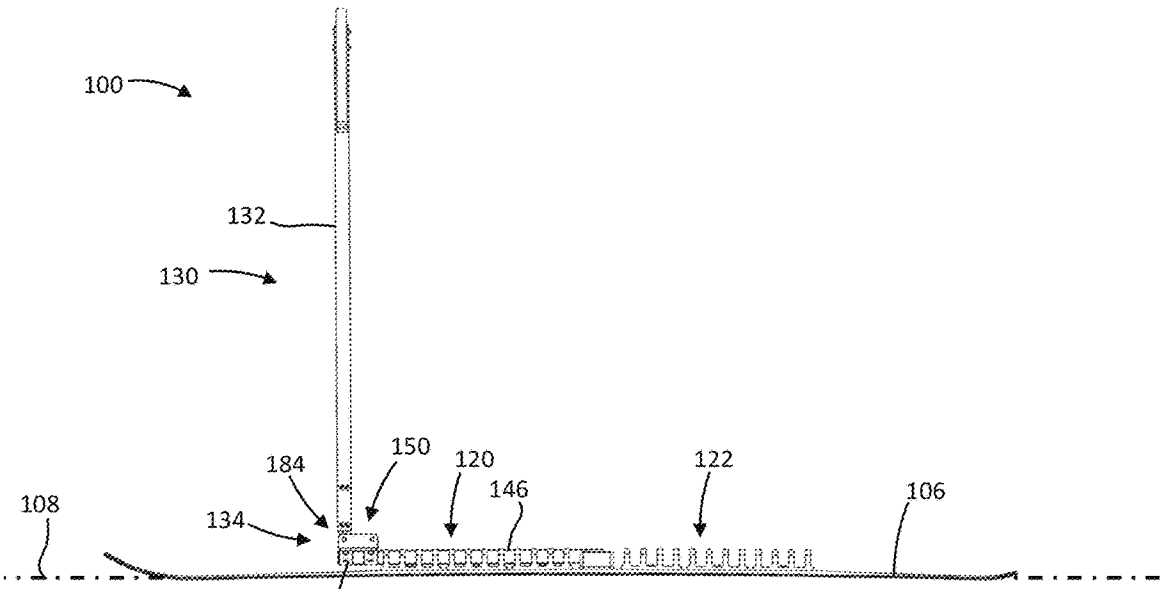
FIG. 10 is a side elevation view of the snow scooter of FIG. 1, showing a control bar of the snow scooter in a deployed position.
Figure 12:
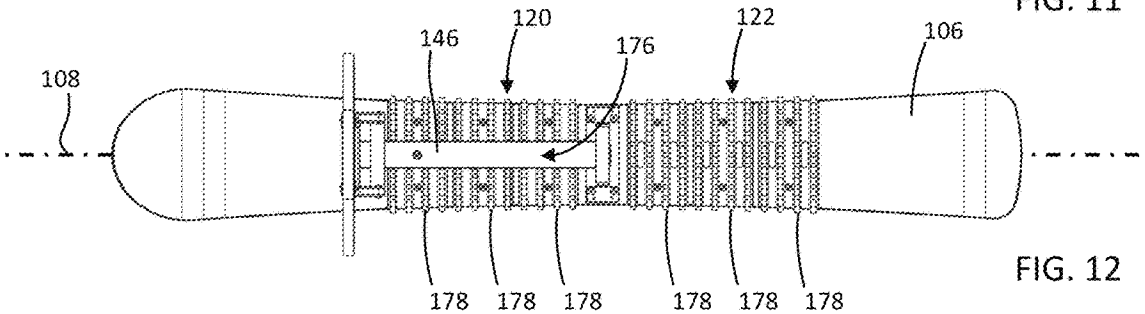
FIG. 12 is a top view of the snow scooter of FIG. 1.

Referring to FIG. 10, in the example illustrated, the torsion bar 146 extends axially through the front foot pad 120. Referring to FIG. 12, in the example illustrated, the front foot pad 120 has a channel 176 extending therethrough along the board axis 108 through which the torsion bar 146 extends at an elevation below an upper extent of front foot pad 120 to allow the front foot of the rider to engage the front foot pad 120 without interference from the torsion bar 146. In the example illustrated, each of the front foot pad 120 and the rear foot pad 122 comprises at least one traction plate 178 mounted to the top surface 106 of the board 102 over respective front-foot and rear-foot support regions 116, 118. In the example illustrated, each of the front foot pad 120 and the rear foot pad 122 comprises a plurality of traction plates 178 spaced axially apart from each other and independently mounted to the top surface 106 to accommodate bending and twisting of the board 102 along the front-foot and rear-foot support regions 116, 118 (and foot pads 120, 122).

In some examples, the lower end 134 of the control bar 132 can be rigidly coupled to the free end 150 of the torsion bar 146. In some alternative examples, the lower end 134 of the control bar 132 can be pivotably coupled to the free end 150 of the torsion bar 146 for permitting pivoting of the control bar 132 about a lateral pivot axis relative to the torsion bar 146, thus enabling a rider to move the handle portion 138 fore and aft relative to the free end 150 when riding the snow scooter. In some alternative examples, the lower end 134 of the control bar 132 can be semi-rigidly coupled to the free end 150 of the torsion bar 146 for permitting limited pivoting of the control bar 132 about a lateral pivot axis relative to the torsion bar 146, thus enabling a rider to urge limited fore and aft movement of the handle portion 138 relative to the free end 150 when riding the snow scooter.

Figure 11:
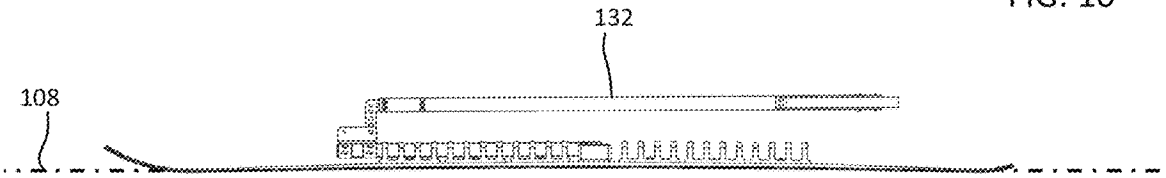
FIG. 11 is a side elevation view like that of FIG. 10, but showing the control bar in a stowed position.

Referring to FIG. 10, in the example illustrated, the free end 150 of the torsion bar 146 comprises a control bar mount 180, and the lower end 134 of the control bar 132 is secured to the control bar mount 180. In the example illustrated, the control bar 132 is pivotably coupled to the control bar mount 180 for pivoting about a lateral pivot axis relative to the torsion bar 146 between a deployed position (shown in FIG. 10) and a stowed position (shown in FIG. 11). Referring to FIG. 10, when in the deployed position, the control bar 132 projects upwardly relative to the top surface 106 of the board 102 generally perpendicular to the board axis 108. Referring to FIG. 11, when in the stowed position, the control bar 132 extends generally parallel to the board axis 108. In the example illustrated, a locking mechanism 184 is provided for locking the control bar 132 relative to the torsion bar 146 in the deployed position during use, and selectively unlocking the control bar 132 for pivoting toward the stowed position. The locking mechanism 184 can comprise, for example, one or more slidable locking pins for insertion through respective locking apertures in the control bar 132 and the control bar mount 180 which are in alignment in the deployed position for receiving the locking pins therethrough.

Figure 13:
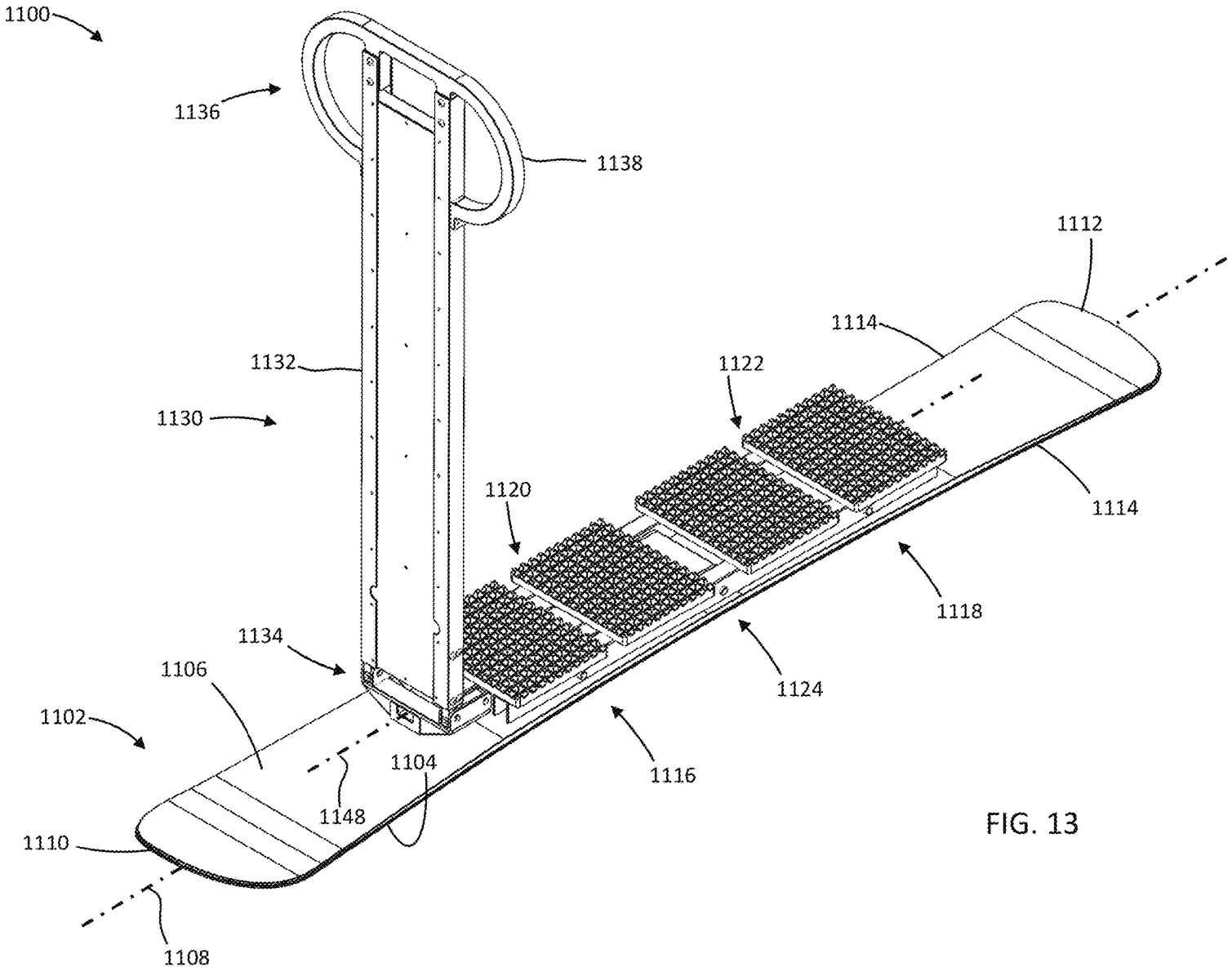
FIG. 13 is a front axonometric projection view of another example snow scooter.

Referring to FIG. 13, another example snow scooter 1100 is shown. The snow scooter 1100 has similarities to the snow scooter 100, and like features are identified with like reference characters, incremented by 1000.

In the example illustrated, the snow scooter 1100 includes a gliding board 1102 having a bottom surface 1104 for gliding on a low-friction substrate. The gliding board 1102 has a top surface 1106 spaced apart from the bottom surface 1104 by a board thickness. The bottom and top surfaces 1104, 1106 extend longitudinally along a board axis 1108 between front and rear edges 1110, 1112 of the board 1102. The bottom and top surfaces 1104, 1106 extend laterally between side edges 1114 of the board 1102.

The top surface 1106 has a front-foot support region 1116 and a rear-foot support region 1118 axially rearward of the front-foot support region 1116. In the example illustrated, a front foot pad 1120 extends over the front-foot support region 1116 and a rear foot pad 1122 extends over the rear-foot support region 1118. In the example illustrated, the top surface 1106 of the board 1102 has a central region 1124 axially intermediate the front-foot and rear-foot support regions 1116, 1118 (and the front and rear foot pads 1120, 1122, in the example illustrated).

In the example illustrated, the snow scooter 1100 includes an edging control assembly 1130 mounted to the board 1102 for controlling an edging angle of the board 1102 between the low-friction substrate and the bottom surface 1104 of the board 1102. In the example illustrated, the edging control assembly 1130 includes a control bar 1132 projecting upwardly from a lower end 1134 of the control bar 1132 to an upper end 1136 comprising a handle portion 1138 for engagement by the rider. In the example illustrated, the lower end 1134 of the control bar 1132 is positioned axially forward of the front-foot support region 1116.

Figure 14:
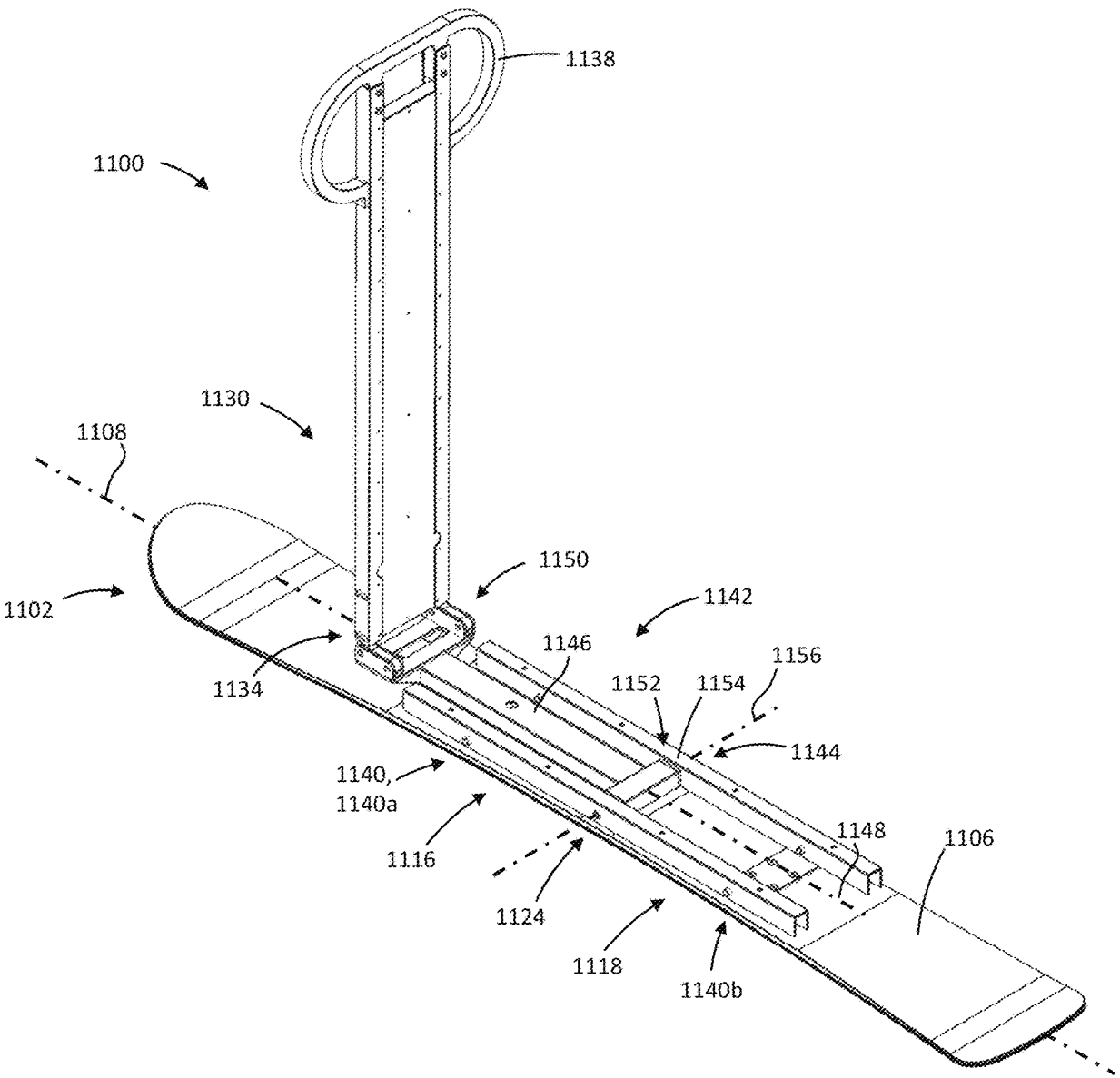
FIG. 14 is a rear axonometric projection view of the snow scooter of FIG. 13, but with footpads removed.
Figure 15:
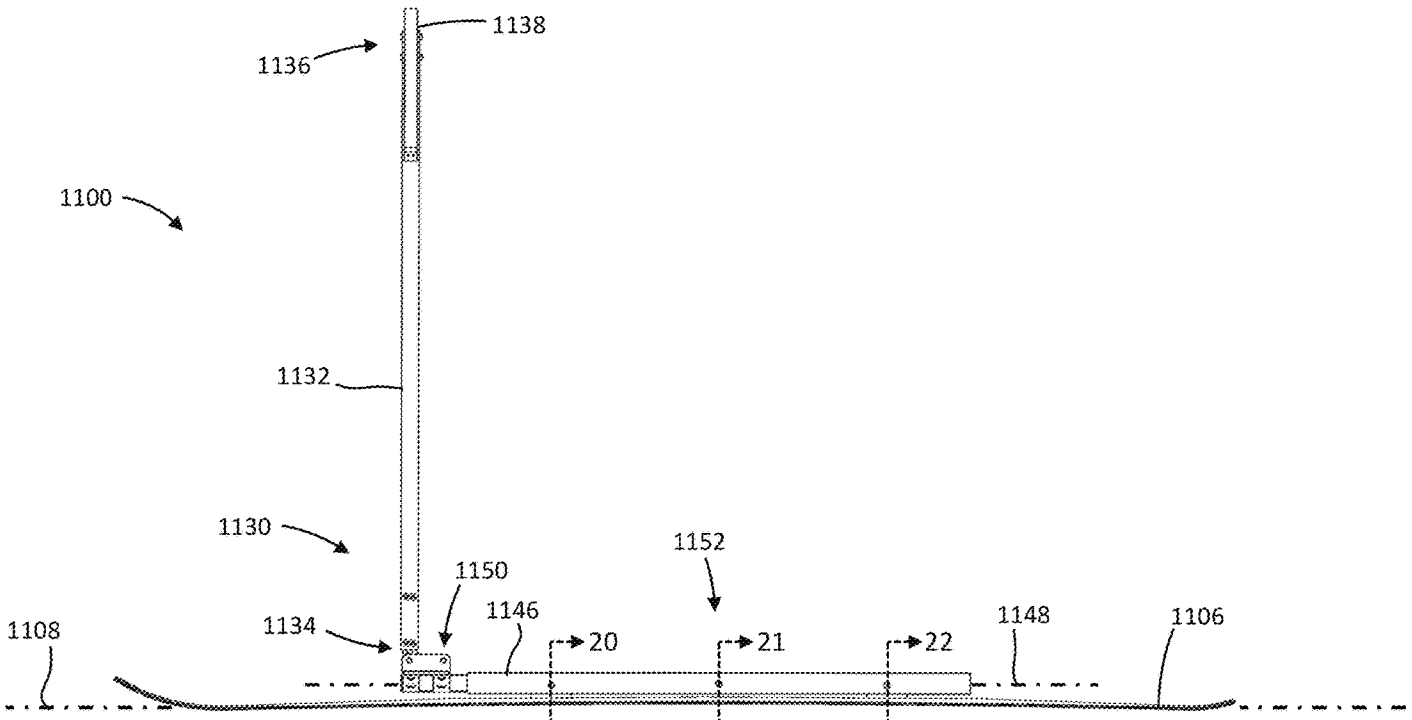
FIG. 15 is a side elevation view of the snow scooter of FIG. 14.

Referring to FIG. 14, in the example illustrated, the top surface 1106 of the board 1102 has at least one anchoring zone 1140, and the edging control assembly 1130 includes a torque-transmission assembly 1142 coupling the control bar 1132 to the at least one anchoring zone 1140. In the example illustrated, the torque-transmission assembly 1142 includes an anchoring structure 1144 fastened to the at least one anchoring zone 1140. In the example illustrated, the torque-transmission assembly 1142 further includes a torsion bar 1146 extending along a torsion bar axis 1148 generally parallel to the board axis 1108 between a free end 1150 and an anchored end 1152 axially opposite the free end 1150. In the example illustrated, the free end 1150 of the torsion bar 1146 is axially forward of the front-foot support region 1116 and rotationally fixed to the lower end 1134 of the control bar 1132 to inhibit relative rotation between the free end 1150 and the lower end 1134 about the torsion bar axis 1148. The anchored end 1152 of the torsion bar 1146 is positioned over the central region 1124 of the board 1102. In the example illustrated, the anchored end 1152 is rotationally fixed to a coupling section 1154 of the anchoring structure 1144 to inhibit relative rotation between the anchored end 1152 and the coupling section 1154 about the torsion bar axis 1148 for applying a tilting torque to the at least one anchoring zone 1140 about the board axis 1108 in response to a lateral force applied to the handle portion 1138 of the control bar 1132 by a rider. This can allow for a control angle between the low-friction substrate and a transverse axis 1156 fixed relative to the anchored end 1152 to correspond to at least one edging angle between the low-friction substrate and the bottom surface 1104 of the board 1102.

Figure 16:
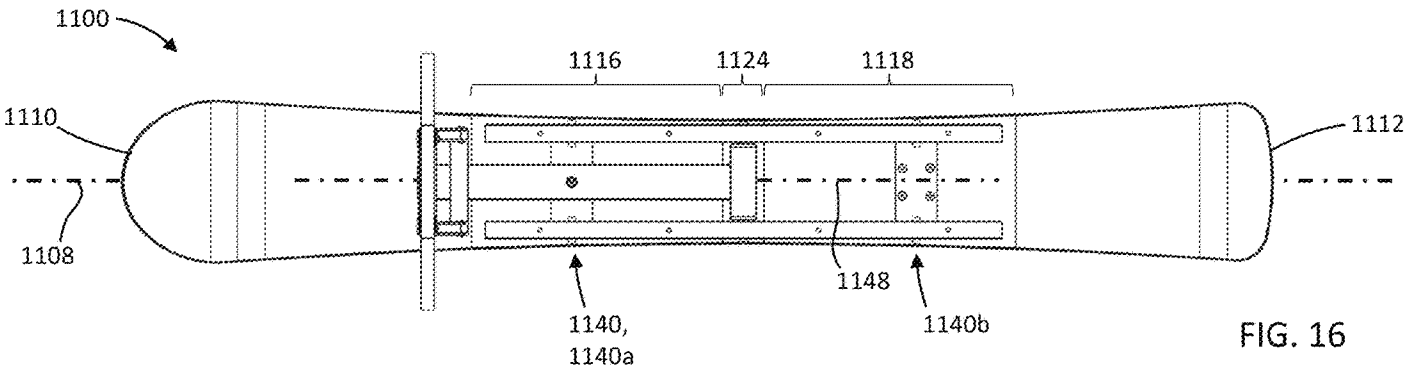
FIG. 16 is a top view of the snow scooter of FIG. 14.

Referring to FIG. 16, in the example illustrated, the at least one anchoring zone 1140 comprises a front anchoring zone 1140*a* forward of the central region 1124 and a rear anchoring zone 1140*b* rearward of the central region 1124 for applying the tilting torque to the front and rear anchoring zones 1140*a*, 1140*b* axially outboard of the central region 1124. In the example illustrated, the control angle corresponds to an average of the edging angle exhibited at a point within the front anchoring zone 1140*a* and the edging angle exhibited at a point within the rear anchoring zone 1140*b*.

In the example illustrated, the front anchoring zone 1140*a* is located within the front-foot support region 1116 and the rear anchoring zone 1140*b* is located within the rear-foot support region 1118. In some examples, at least a portion or an entirety of the front anchoring zone 1140*a* may be located forward of the front-foot support region 1116, and/or at least a portion or an entirety of the rear anchoring zone 1140*b* may be located rearward of the rear-foot support region 1118. In some examples, at least a portion or an entirety of the front anchoring zone 1140*a* may be located axially intermediate the anchored end 1152 of the torsion bar 1146 and the front-foot support region 1116, and/or at least a portion or an entirety of the rear anchoring zone 1140*b* may be located axially intermediate the anchored end 1152 of the torsion bar 1146 and the rear-foot support region 1118.

Figure 17:
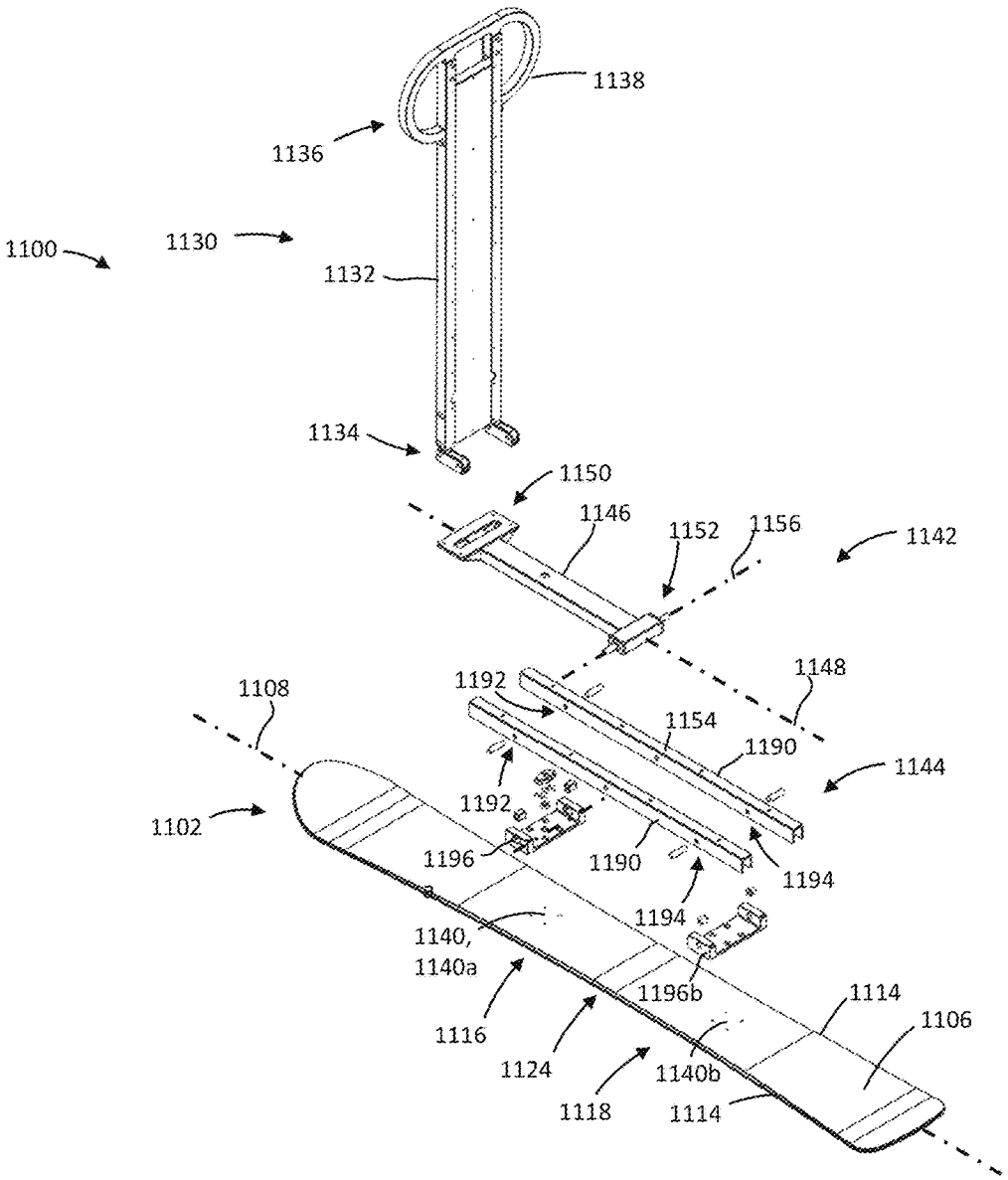
FIG. 17 is an exploded axonometric projection view of the snow scooter of FIG. 14.

Referring to FIG. 17, in the example illustrated, the anchoring structure 1144 comprises a pair of beam members 1190 spaced laterally apart from each other toward respective side edges 1114 of the board 1102 and positioned on laterally opposite sides of the torsion bar axis 1148. Each beam member 1190 extends along the board axis 1108 between a front portion 1192 and a rear portion 1194 axially rearward of the front portion 1192. The front portion 1192 of each beam member 1190 is vertically fixed to the front anchoring zone 1140*a*, and the rear portion 1194 of each beam member 1190 is vertically fixed to the rear anchoring zone 1140*b*. In the example illustrated, the anchoring structure 1144 includes a front mounting bracket 1196*a* fastened to the front anchoring zone 1140*a* (e.g. through a plurality of fasteners 1170-FIG. 18). The front portion 1192 of each beam member 1190 is coupled to the front mounting bracket 1196*a* to vertically fix the front portion 1192 to the front anchoring zone 1140*a*. In the example illustrated, the anchoring structure 1144 further includes a rear mounting bracket 1196*b* fastened to the rear anchoring zone 1140*b* (e.g. through a plurality of fasteners 1170-FIG. 18). The rear portion 1194 of each beam member 1190 is coupled to the rear mounting bracket 1196*b* to vertically fix the rear portion 1194 to the rear anchoring zone 1140*b*.

Figure 18:
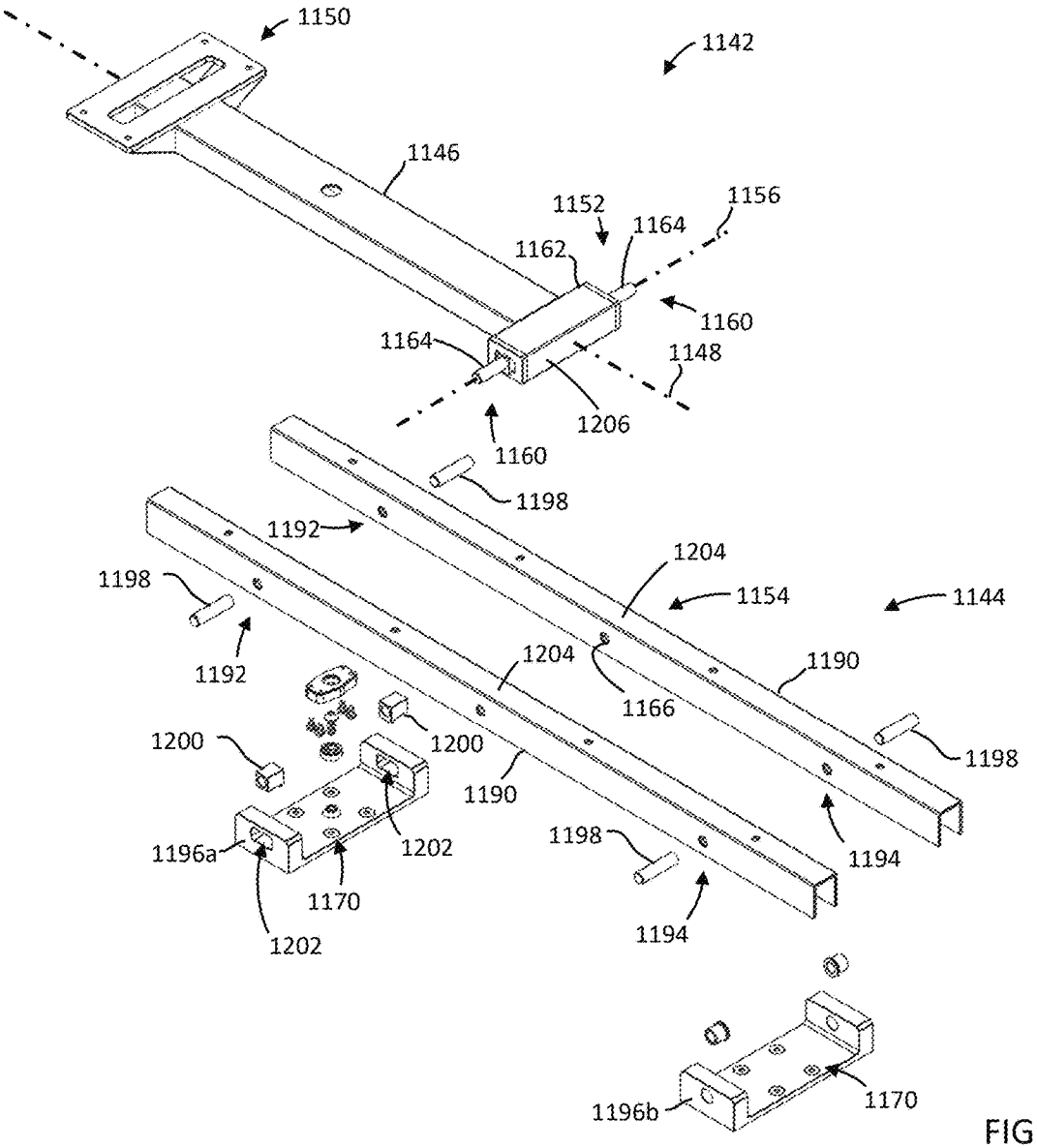
FIG. 18 is an exploded top axonometric projection view of a torque-transmission assembly of the snow scooter of FIG. 14.

In the example illustrated, at least one of the front portion 1192 and the rear portion 1194 of each beam member 1190 is axially slidable relative to a respective front and rear anchoring zone 1140*a*, 1140*b* to accommodate vertical deflection (bending) of the board 1102. Referring to FIG. 18, in the example illustrated, the front portions 1192 and the rear portions 1194 of the beam members 1190 are coupled to respective front and rear mounting brackets 1196*a*, 1196*b* through respective pivot pins 1198, and the front portions 1192 of the beam members 1190 are axially slidable relative to the front mounting bracket 1196*a*. In the example illustrated, the pivot pin 1198 for the front portion 1192 of each beam member 1190 is received in a respective slider block 1200, which is slidably mounted in a respective axially extending slot 1202 of the front mounting bracket 1196*a*.

In the example illustrated, each beam member 1190 has a central portion 1204 axially intermediate the front and rear portions 1192, 1194 and extending over the central region 1124 of the board 1102. In the example illustrated, the central portions 1204 of the pair of beams 1190 define the coupling section 1154 of the anchoring structure 1144. During application of a lateral force to the handle portion 1138 of the control bar 1132 by a rider, the anchored end 1152 of the torsion bar 1146 exerts an upward force to the central portion 1204 of one of the beam members 1190 and a downward force to the central portion 1204 of the other beam member 1190, and these forces are transmitted through the beam members 1190 and mounting brackets 1196*a*, 1196*b* to apply the tilting torque to the front and rear anchoring zones 1140*a*, 1140*b*. In the example illustrated, the beam members 1190 are spaced laterally apart from each other, with the anchored end 1152 of the torsion bar 1146 laterally intermediate the pair of beam members 1190. In some example embodiments wherein a snowboard is used as the board of the snow scooter, the front mounting bracket 1196*a* may be fastened to at least one of the front binding mount inserts of the snowboard, and the rear mounting bracket 1196*b* may be fastened to at least one of the rear binding mount inserts of the snowboard.

In the example illustrated, the anchored end 1152 of the torsion bar 1146 has a pair of attachment points 1160 spaced laterally apart from each other toward respective side edges 1114 of the board 1102 and positioned on laterally opposite sides of the torsion bar axis 1148. In the example illustrated, each attachment point 1160 is vertically fixed to the central portion 1204 of a respective beam member 1190 (over the central region 1124 of the board 1102) for rotationally fixing the anchored end 1152 to the coupling section 1154 of the anchoring structure 1144 to inhibit relative rotation between the anchored end 1152 and the coupling section 1154 about the torsion bar axis 1148. In the example illustrated, the anchored end 1152 comprises a lever 1162 extending transversely to the torsion bar axis 1148 along the transverse axis 1156 between a pair of laterally opposed lever ends 1164 defining respective attachment points 1160. In the example illustrated, the central portion 1204 of each beam member 1190 has a mounting aperture 1166. The mounting apertures 1166 are spaced laterally apart from each other on laterally opposite sides of, and directed laterally inwardly toward, the board axis 1108 (and the torsion bar axis 1148). Each lever end 1164 is received and held vertically captive in a respective mounting aperture 1166.

In some examples, the attachment points 1160 can be axially offset relative to each other along the torsion bar axis 1148 (e.g. with the attachment point on one side of the torsion bar axis 1148 being positioned axially rearward of the attachment point on the opposite side of the torsion bar axis 1148). In such examples, the anchored end can have a lever extending along an oblique angle relative to the torsion bar axis 1148 between axially offset lever ends defining the attachment points on opposite sides of the torsion bar axis 1148. In such examples, the anchored end may have a lever that is not parallel to the transverse axis. In some examples, this can help accommodate a forward stance of the rider, with their feet angled toward the front of the board, while allowing for application of the "pedaling" technique by the rider's feet to apply counter-torque for edging angle manipulation (e.g. by moving the lever generally clear of the toe of the athlete's rear foot and heel of the athlete's front foot).

Figure 19:
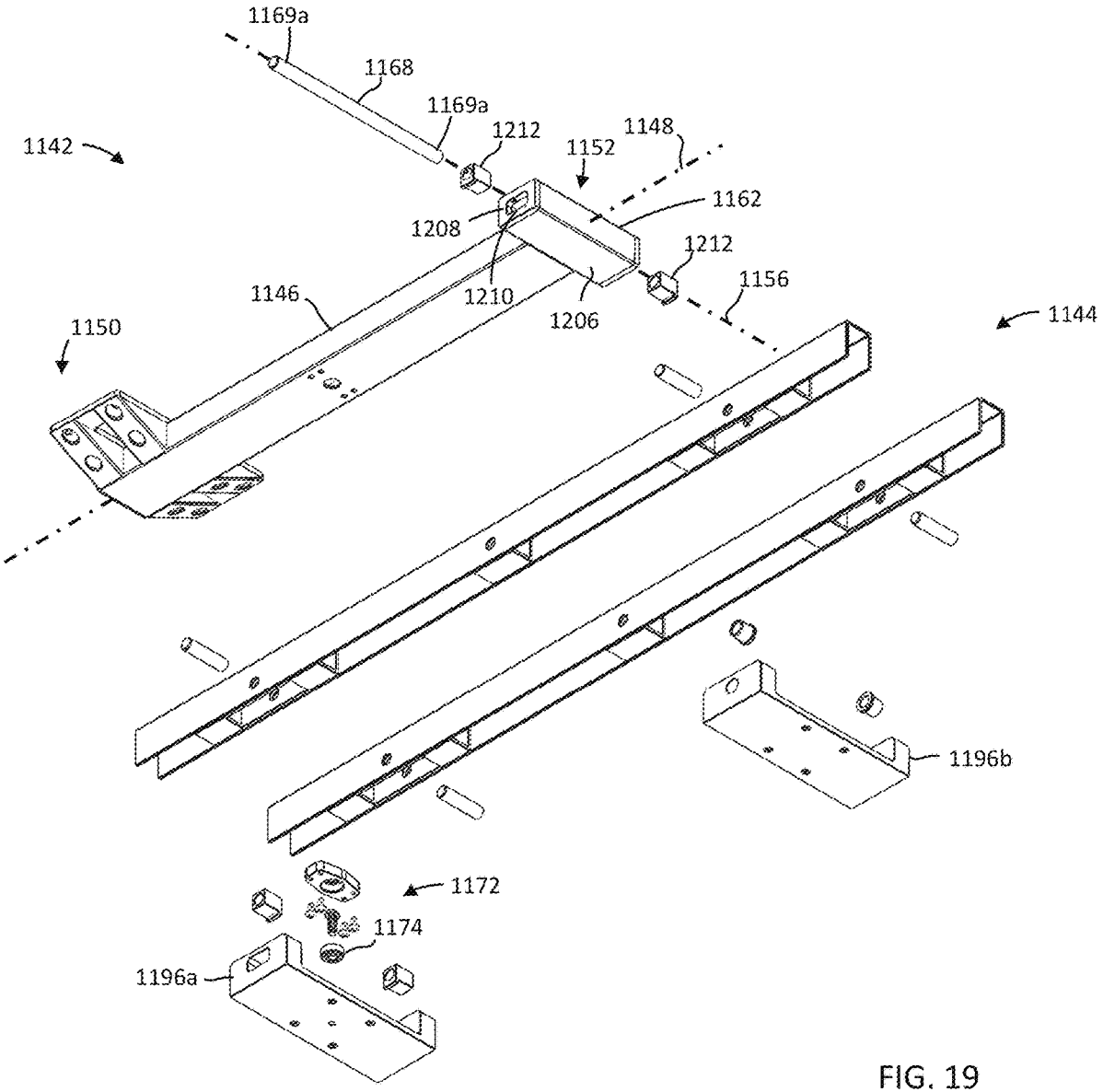
FIG. 19 is an exploded bottom axonometric projection view of the torque-transmission assembly of FIG. 18.
Figure 21:
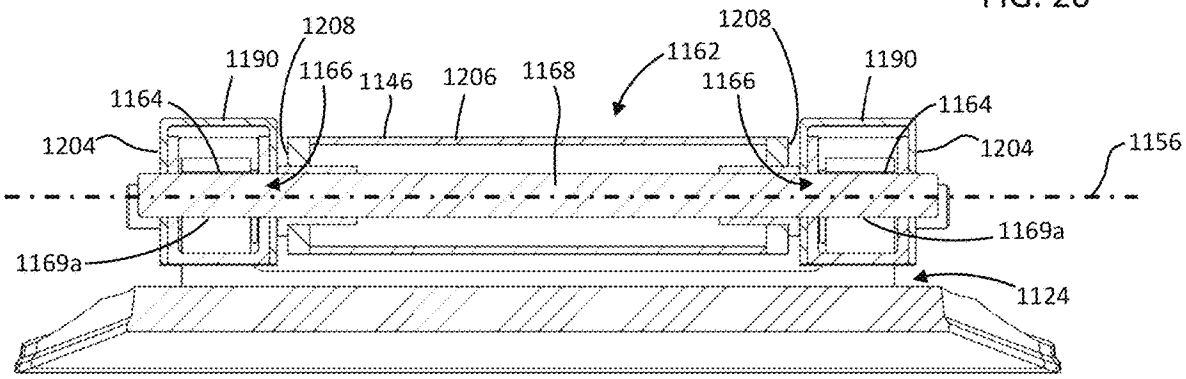
FIG. 21 is another cross-sectional view of the snow scooter of FIG. 14, taken along line 21-21 of FIG. 15.
Figure 22:
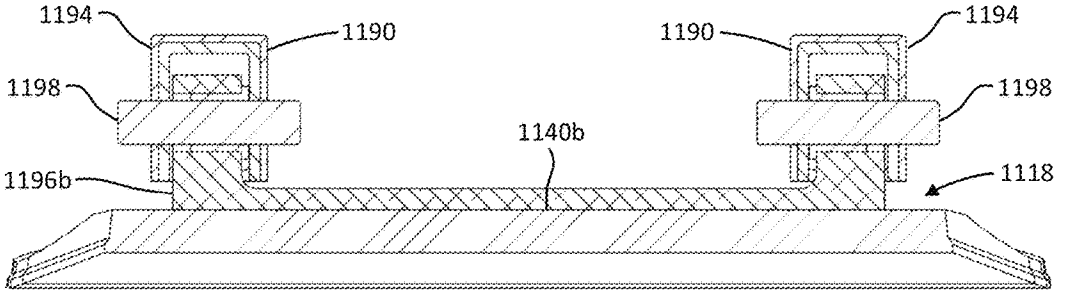
FIG. 22 is a cross-sectional view of the snow scooter of FIG. 14, taken along line 22-22 of FIG. 15.

Referring to FIG. 21, in the example illustrated, each lever end 1164 comprises a respective pivot pin 1169*a* extending along the transverse axis 1156. Each pivot pin 1169*a* is received in a mounting aperture 1166 of a respective beam member 1190 for accommodating limited pivoting of the torsion bar 1146 relative to the board 1102 about the transverse axis 1156 (e.g. during bending of the board 1102). Referring to FIG. 19, in the example illustrated, the lever 1162 has a lever body 1206 extending along the transverse axis 1156 between opposed endfaces 1208, and an axle 1168 extending along the transverse axis 1156 and through the lever body 1206 between laterally opposed ends of the axle 1168 defining the pivot pins 1169*a* which project from the endfaces 1208. Each endface 1208 of the lever body has an axially extending slot 1210 and the axle 1168 extends through and is slidably mounted in the slots 1210 for vertically fixing the axle 1168 relative to the lever body 1206 while accommodating limited axial translation of the axle 1168 (and pivot pins 1169*a*) relative to the lever body 1206. In the example illustrated, the axle 1168 passes through a pair of slider blocks 1212 received in respective slots 1210.

In the example illustrated, the front portion 1192 of each beam member 1190 is forward of a respective attachment point 1160 of the anchored end 1152 of the torsion bar 1146, and a front end of each beam member 1190 can be positioned over or forward of the front anchoring zone 1140*a*. In the example illustrated, the rear portion 1194 of each beam member 1190 is rearward of a respective attachment point 1160 of the anchored end 1152 of the torsion bar 1146, and a rear end of each beam member 1190 can be positioned over or rearward of the rear anchoring zone 1140*b*.

Figure 20:
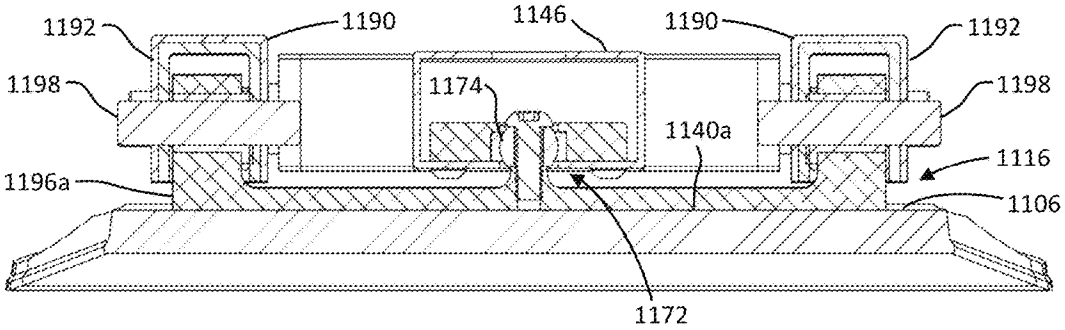
FIG. 20 is a cross-sectional view of the snow scooter of FIG. 14, taken along line 20-20 of FIG. 15.

Referring to FIG. 20, in the example illustrated, the torque-transmission assembly 1142 includes a support 1172 projecting upwardly relative to the top surface 1106 and atop which the torsion bar 1146 is supported to hold the free end 1150 of the torsion bar 1146 above the top surface 1106 of the board 1102. In the example illustrated, the support 1172 comprises a spherical bearing 1174 for accommodating flexural and torsional deformation of the board 1102. In the example illustrated, the spherical bearing 1174 is mounted atop the front mounting bracket 1196*a* over which the torsion bar 1146 extends, and is coupled to a bottom of the torsion bar 1146 toward the free end 1150 and limits horizontal and vertical translation of the torsion bar 1146 while accommodating the flexural and torsional deformation of the board 1102.

In some examples, the anchoring structure can include beam members that form portions of a compliant structure (permitting limited elastic deformation) that retains the scissoring (i.e. vertically opposite deflection) behavior of the pair of beam members 1190. For example, in some embodiments, beam members may be an integral portion of a plate structure configured to offer torsional compliance and function similarly to having independent beam members.

The invention claimed is:

1. A snow scooter comprising:

a) a gliding board having a bottom surface for gliding on a low-friction substrate and a top surface spaced apart from the bottom surface by a board thickness, the top and bottom surfaces extending longitudinally along a board axis between front and rear edges of the board and extending laterally between side edges of the board, and the top surface having a front-foot support region, a rear-foot support region axially rearward of the front-foot support region, and a central region axially intermediate the front-foot and rear-foot support regions; and b) an edging control assembly mounted to the board for controlling an edging angle between the low-friction substrate and the bottom surface of the board, the edging control assembly including:

i) a control bar projecting upwardly from a lower end of the control bar adjacent the top surface of the board to an upper end of the control bar, the upper end comprising a handle portion, and the lower end positioned axially forward of the front-foot support region, and ii) a torque-transmission assembly coupling the control bar to the board, the torque-transmission assembly including a torsion bar extending along a torsion bar axis generally parallel to the board axis between a free end and an anchored end of the torsion bar, the free end rotationally fixed to the lower end of the control bar to inhibit relative rotation between the free end and the lower end about the torsion bar axis, and the anchored end rotationally fixed to the central region to inhibit relative rotation between the anchored end and the central region about the torsion bar axis for applying a tilting torque to the central region about the board axis in response to a lateral force applied to the handle portion by a rider.

2. The snow scooter of claim 1, wherein the anchored end comprises a pair of attachment points spaced laterally apart from each other toward respective side edges of the board and positioned on laterally opposite sides of the torsion bar axis, each attachment point vertically fixed to the central region for vertically and rotationally fixing the anchored end thereto.

3. The snow scooter of claim 2, wherein each of the attachment points is slidably coupled to the central region to accommodate limited axial translation of the attachment points along the board axis.

4. The snow scooter of claim 2, wherein the anchored end comprises a lever extending transversely to the torsion bar axis between a pair of opposed lever ends, each lever end comprising a respective attachment point.

5. The snow scooter of claim 4, wherein the torque-transmission assembly comprises a mounting bracket fastened to the central region, the mounting bracket including a pair of mounting apertures spaced laterally apart from each other on laterally opposite sides of the torsion bar axis and directed laterally inwardly toward the torsion bar axis, and wherein each lever end is received and held vertically captive in a respective mounting aperture.

6. The snow scooter of claim 5, wherein each mounting aperture comprises a slot extending along the board axis, and each lever end is slidably received in a respective slot for accommodating limited axial translation of the lever end along the slot.

7. The snow scooter of claim 1, wherein the torque-transmission assembly includes a support projecting upwardly relative to the top surface and atop which the torsion bar is supported to hold the free end of the torsion bar above the top surface of the board.

8. The snow scooter of claim 1, further comprising a front foot pad extending over the front-foot support region and a rear foot pad extending over the rear-foot support region.

9. A snow scooter comprising:

a) a gliding board having a bottom surface for gliding on a low-friction substrate and a top surface spaced apart from the bottom surface by a board thickness, the top and bottom surfaces extending longitudinally along a board axis between front and rear edges of the board and extending laterally between side edges of the board, and the top surface having a front-foot support region, a rear-foot support region axially rearward of the front-foot support region, a central region axially intermediate the front-foot and rear-foot support regions, and at least one anchoring zone; and b) an edging control assembly mounted to the board for controlling an edging angle between the low-friction substrate and the bottom surface of the board, the edging control assembly including:

i) a control bar projecting upwardly from a lower end of the control bar adjacent the top surface of the board to an upper end of the control bar, the upper end comprising a handle portion, and the lower end positioned axially forward of the front-foot support region, and ii) a torque-transmission assembly coupling the control bar to the at least one anchoring zone, the torque-transmission assembly including an anchoring structure fastened to the at least one anchoring zone, and a torsion bar extending along a torsion bar axis generally parallel to the board axis between a free end and an anchored end of the torsion bar, the free end rotationally fixed to the lower end of the control bar to inhibit relative rotation between the free end and the lower end about the torsion bar axis, and the anchored end positioned over the central region and rotationally fixed to a coupling section of the anchoring structure to inhibit relative rotation between the anchored end and the coupling section about the torsion bar axis for applying a tilting torque to the at least one anchoring zone about the board axis in response to a lateral force applied to the handle portion by a rider.

10. The snow scooter of claim 9, wherein the anchored end comprises a pair of attachment points spaced laterally apart from each other toward respective side edges of the board and positioned on laterally opposite sides of the torsion bar axis, each attachment point vertically fixed to the coupling section of the anchoring structure for vertically and rotationally fixing the anchored end thereto.

11. The snow scooter of claim 10, wherein each of the attachment points is slidably coupled to the coupling section of the anchoring structure to accommodate limited axial translation of the attachment points along the board axis.

12. The snow scooter of claim 10, wherein the anchored end comprises a lever extending transversely to the torsion bar axis between a pair of opposed lever ends, each lever end comprising a respective attachment point.

13. The snow scooter of claim 12, wherein the coupling section of the anchoring structure includes a pair of mounting apertures spaced laterally apart from each other on laterally opposite sides of the torsion bar axis and directed laterally inwardly toward the torsion bar axis, and wherein each lever end is received and held vertically captive in a respective mounting aperture.

14. The snow scooter of claim 13, wherein each mounting aperture comprises a slot extending along the board axis, and each lever end is slidably received in a respective slot for accommodating limited axial translation of the lever end along the slot.

15. The snow scooter of claim 9, wherein the board has a length between the front edge and the rear edge, and the central region is located within a central third of the length.

16. The snow scooter of claim 9, wherein the torque-transmission assembly includes a support projecting upwardly relative to the top surface and atop which the torsion bar is supported to hold the free end of the torsion bar above the top surface of the board.

17. The snow scooter of claim 16, wherein the support comprises a spherical bearing for accommodating flexural and torsional deformation of the board.

18. The snow scooter of claim 9, further comprising a front foot pad extending over the front-foot support region and a rear foot pad extending over the rear-foot support region.

19. The snow scooter of claim 18, wherein each of the front and rear foot pads comprises a plurality of traction plates spaced axially apart from each other and independently mounted to the top surface to accommodate bending and twisting of the board along the front-foot and rear-foot support regions.

20. The snow scooter of claim 9, wherein the at least one anchoring zone is located within the central region of the board for applying the tilting torque to the central region.

21. The snow scooter of claim 20, wherein the anchoring structure comprises a mounting bracket fastened to the central region, and the anchored end of the torsion bar is rotationally fixed to the mounting bracket to inhibit relative rotation about the torsion bar axis.

22. The snow scooter of claim 9, wherein the at least one anchoring zone comprises a front anchoring zone forward of the central region and a rear anchoring zone rearward of the central region for applying the tilting torque to the front and rear anchoring zones axially outboard of the central region.

23. The snow scooter of claim 22, wherein the anchoring structure comprises a pair of beam members spaced laterally apart from each other toward respective side edges of the board and positioned on laterally opposite sides of the torsion bar axis, each beam member extending along the board axis between a front portion of the beam member vertically fixed to the front anchoring zone and a rear portion of the beam member vertically fixed to the rear anchoring zone.

24. The snow scooter of claim 23, wherein the anchored end of the torsion bar has a pair of attachment points spaced laterally apart from each other toward respective side edges of the board and positioned on laterally opposite sides of the torsion bar axis, and each attachment point is vertically fixed relative to a respective beam member over the central region for rotationally fixing the anchored end to the coupling section of the anchoring structure to inhibit relative rotation between the anchored end and the coupling section about the torsion bar axis.

25. A snow scooter comprising:

a) a gliding board having a bottom surface for gliding on a low-friction substrate and a top surface spaced apart from the bottom surface by a board thickness, the top and bottom surfaces extending longitudinally along a board axis between front and rear edges of the board and extending laterally between side edges of the board, and the top surface having a front-foot support region, a rear-foot support region axially rearward of the front-foot support region, a central region axially intermediate the front-foot and rear-foot support regions, and at least one anchoring zone; and b) an edging control assembly mounted to the board, the edging control assembly including:

i) a control bar projecting upwardly from a lower end of the control bar adjacent the top surface of the board to an upper end of the control bar, the upper end comprising a handle portion, and the lower end positioned axially forward of the front-foot support region, and ii) a torque-transmission assembly coupling the control bar to the at least one anchoring zone, the torque-transmission assembly including an anchoring structure fastened to the at least one anchoring zone, and a torsion bar extending along a torsion bar axis generally parallel to the board axis between a free end and an anchored end of the torsion bar, the free end rotationally fixed to the lower end of the control bar to inhibit relative rotation between the free end and the lower end about the torsion bar axis, and the anchored end positioned over the central region and rotationally fixed to a coupling section of the anchoring structure to inhibit relative rotation between the anchored end and the coupling section about the torsion bar axis such that a control angle between the low-friction substrate and a transverse axis fixed relative to the anchored end corresponds to at least one edging angle between the low-friction substrate and the bottom surface of the board.

26. The snow scooter of claim 25, wherein the control angle corresponds to at least one of: the edging angle exhibited at one or more points along the board, and an average of edging angles exhibited at a plurality of respective points along the board.

27. The snow scooter of claim 25, wherein the at least one anchoring zone is located within the central region of the board and the control angle corresponds to the edging angle exhibited at one or more points within the central region of the board.

28. The snow scooter of claim 25, wherein the at least one anchoring zone comprises a front anchoring zone forward of the central region and a rear anchoring zone rearward of the central region, and the control angle corresponds to an average of the edging angle exhibited at a point within the front anchoring zone and the edging angle exhibited at a point within the rear anchoring zone.

29. The snow scooter of claim 28, wherein the anchoring structure comprises a pair of beam members spaced laterally apart from each other toward respective side edges of the board and positioned on laterally opposite sides of the torsion bar axis, each beam member extending along the board axis between a front portion of the beam member vertically fixed to the front anchoring zone and a rear portion of the beam member vertically fixed to the rear anchoring zone.

30. The snow scooter of claim 29, wherein the anchored end of the torsion bar has a pair of attachment points spaced laterally apart from each other toward respective side edges of the board and positioned on laterally opposite sides of the torsion bar axis, and each attachment point is vertically fixed relative to a respective beam member over the central region for rotationally fixing the anchored end to the coupling section of the anchoring structure to inhibit relative rotation between the anchored end and the coupling section about the torsion bar axis.

* * * * *